US009781508B2

(12) United States Patent
Katagiri

(10) Patent No.: US 9,781,508 B2
(45) Date of Patent: Oct. 3, 2017

(54) SOUND PICKUP DEVICE, PROGRAM RECORDED MEDIUM, AND METHOD

(71) Applicant: Oki Electric Industry Co., Ltd., Tokyo (JP)

(72) Inventor: Kazuhiro Katagiri, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 115 days.

(21) Appl. No.: 14/973,154

(22) Filed: Dec. 17, 2015

(65) Prior Publication Data

US 2016/0198258 A1 Jul. 7, 2016

(30) Foreign Application Priority Data

Jan. 5, 2015 (JP) ..... 2015-000520
Jan. 5, 2015 (JP) ..... 2015-000527
Jan. 5, 2015 (JP) ..... 2015-000531

(51) Int. Cl.
*H04R 1/40* (2006.01)

(52) U.S. Cl.
CPC ..... *H04R 1/406* (2013.01); *H04R 2410/01* (2013.01)

(58) Field of Classification Search
None
See application file for complete search history.

(56) References Cited

U.S. PATENT DOCUMENTS 7,149,691 B2 * 12/2006 Balan ..... G10L 15/22 704/270
9,318,124 B2 * 4/2016 Hiroe ..... G10L 21/0216
9,445,194 B2 * 9/2016 Katagiri ..... H04R 1/406
2013/0029684 A1 * 1/2013 Kawaguchi ..... H04R 3/005 455/456.1
2013/0083832 A1 * 4/2013 Sorensen ..... G01S 3/805 375/224
2016/0187453 A1 * 6/2016 Wang ..... H04R 3/005 367/127

FOREIGN PATENT DOCUMENTS

JP 2014-072708 A 4/2014

OTHER PUBLICATIONS

Asano Futoshi, "Acoustical Technology Series 16: Array Signal Processing for Acoustics—Localization, Tracking, and Separation of Sound Sources", The Acoustical Society of Japan, published Feb. 25, 2011 by Corona Publishing.

* cited by examiner

*Primary Examiner* — Paul Huber
(74) *Attorney, Agent, or Firm* — Rabin & Berdo, P.C.

(57) ABSTRACT

A sound pickup device is provided, the device including (1) a directionality forming unit that forms directionality to output of a microphone array, (2) a target area sound extraction unit that extracts non-target area sound from output of the directionality forming unit, and that suppresses non-target area sound components extracted from output of the directionality forming unit so as to extract target area sound, (3) a determination information computation unit that computes determination information, (4) an area sound determination unit that determines whether or not target area sound is present using the determination information computed by the determination information computation unit, and (5) an output unit that outputs the target area sound extracted only in cases in which the target area sound is determined to be present by the area sound determination unit.

16 Claims, 16 Drawing Sheets

FIG.16

| | TARGET AREA SOUND SEGMENT DETERMINATION | | | | | |
|---|---|---|---|---|---|---|
| AMPLITUDE SPECTRUM RATIO SUM VALUE | Y | N | Y | | N | |
| COHERENCE SUM VALUE | Y | N | N | | Y | |
| FINALIZED DETERMINATION | Y | N | CONTINUED LESS THAN M TIMES | Y | CONTINUED LESS THAN N TIMES | N |
| | | | CONTINUED M TIMES OR MORE | RAISE HRESHOLD VALUE OF AMPLITUDE SPECTRUM RATIO SUM VALUE AND RE-DETERMINE | CONTINUED N TIMES OR MORE | LOWER THRESHOLD VALUE OF AMPLITUDE SPECTRUM RATIO SUM VALUE AND RE-DETERMIN |

SOUND PICKUP DEVICE, PROGRAM RECORDED MEDIUM, AND METHOD

CROSS-REFERENCE TO RELATED APPLICATION

This application claims priority under 35 USC 119 from Japanese Patent applications No. 2015-000520, No. 2015-000527, and No. 2015-000531 filed on Jan. 5, 2015, the disclosure of which is incorporated by reference herein.

BACKGROUND

Technical Field

The present disclosure relates to a sound pickup device, program recorded medium, and method, and is applicable to, for example, a sound pickup device, program recorded medium, or method that emphasizes sound in a specific area and suppresses sound outside of that area.

Related Art

A beamformer (BF hereafter) employing a microphone array is conventional technology that selectively picks up only sound from a specific direction (also referred to as a "target direction" below) in an environment in which plural sources of sound are present (see the following document: Asano Futoshi, "Acoustical Technology Series 16: Array Signal Processing for Acoustics—Localization, Tracking, and Separation of Sound Sources", The Acoustical Society of Japan, published Feb. 25, 2011 by Corona Publishing). A BF is technology for forming directionality using time differences in signals arriving at respective microphones.

Conventional BFs can be broadly divided into two categories: addition-types and subtraction-types. Subtraction-type BFs in particular have the advantage of being able to give directionality using a small number of microphones compared to addition-type BFs. The device described by Japanese Patent Application Laid-open (JP-A) No. 2014-72708 is a device that applies a conventional subtraction-type BF.

Explanation is given below regarding an example of a configuration for a conventional subtraction-type BF.

FIG. 18 is an explanatory diagram illustrating a configuration example of a sound pickup device PS applying a conventional subtraction-type BF.

The sound pickup device PS illustrated in FIG. 18 extracts target sound (sound from a target direction) from output of a microphone array MA configured using two microphones M1, M2.

FIG. 18 illustrates the sound signals captured by the microphones M1 and M2 as $x_1$ (t) and $x_2$ (t), respectively. Moreover, the sound pickup device PS illustrated in FIG. 18 includes a delay device DEL and a subtraction device SUB.

The delay device DEL aligns phase difference in target sound by computing a time difference $ti_L$ between the signals $x_1$ (t) and $x_2$ (t) arriving at the respective microphones M1, M2, and adding a delay. Hereafter, the signal given by adding the time difference $ti_L$ worth of delay to $x_1$ (t) is denoted $x_1$ $(t-\tau_L)$.

The delay device DEL computes the time difference $\tau_L$ using Equation (1) below. In Equation (1) below, d denotes the distance between the microphones M1 and M2, c denotes the speed of sound, and $\tau_L$ denotes the amount of delay. Moreover, in Equation (1) below, $\theta_L$ denotes the angle formed between a direction orthogonal to a straight line connecting the microphones M1, M2 together, and the target direction.

$$\tau_L=(d \sin \theta_L)/c \tag{1}$$

Here, delay processing is performed on the input signal $x_1$ (t) of the microphone M1 when a blind spot is present facing the microphone M1 from the center (central point) between the microphones M1, M2. The subtraction device SUB, for example, performs processing that subtracts $x_1$ $(t-\tau_L)$ from $x_2$ (t) using Equation (2) below.

$$\alpha(t)=x_2(t)-x_1(t-\tau_L) \tag{2}$$

The subtraction device SUB can also perform subtraction processing in the frequency domain. In such cases, Equation (2) above can be represented by Equation (3) below.

$$A(\omega)=X_2(\omega)-e^{-j}\omega\tau^L X_1(\omega) \tag{3}$$

Here, when $\theta_L=\pm\pi/2$, the directionality formed by the microphone array MA is like that illustrated in FIG. 19A, forming unidirectionality with the form of a cardioid. On the other hand, when $\theta_L=0, \pi$, the directionality formed by the microphone array MA is bidirectional in a figure-eight like that illustrated in FIG. 19B. Hereafter, filters that give unidirectionality from an input signal are referred to as unidirectional filters, and filters that give bidirectionality are referred to as bidirectional filters. Moreover, in the subtraction device SUB, strong directionality can also be formed at the blind spot of bidirectionality using spectral subtraction (also referred to as simply "SS" hereafter) processing.

The subtraction device SUB can perform subtraction processing using Equation (4) below when directionality is formed using SS. Although the input signal $X_1$ of the microphone M1 is employed in Equation (4) below, similar effects can also be obtained for the input signal $X_2$ of the microphone M2. In Equation (4) below, β is a coefficient for adjusting the strength of the SS. The subtraction device SUB may perform processing to substitute in 0 or a value reduced from the original value (flooring processing) when the result value from performing the subtraction processing employing Equation (4) below is negative. In the subtraction device SUB, by performing subtraction processing using the SS method, target area sound can be emphasized by extracting sound present in directions other than that of the target area, and subtracting the amplitude spectrum of the extracted sounds (sounds present in directions other than that of the target area) from the amplitude spectrum of the input signal.

$$|Y(\omega)|=|X_1(\omega)|-\beta|A(\omega)| \tag{4}$$

In conventional sound pickup devices, when desiring to only pickup sound present within a specific area (referred to as "target area sound" hereafter), when using a subtraction-type BF alone, the possibility remains that sound sources present in the surroundings of the target area (referred to as "non-target area sound" hereafter) might also be picked up.

Thus, for example, JP-A No. 2014-72708 proposes processing that picks up target area sound (referred to as "target area sound pickup processing" hereafter) by using plural microphone arrays to cause directionalities to face toward the target area from separate individual directions, and to cause the directionalities to intersect at the target area as illustrated in FIG. 20. In this method, first, a power ratio is estimated for target area sound included in the BF output of the respective microphone arrays, to give a correction coefficient.

FIG. 20 illustrates an example of conventional technology in which target area sound is picked up using two microphone arrays MA1, MA2. When two microphone arrays MA1, MA2 are employed to pick up target area sound with target area sound as the sound source, the correction coefficients for the target area sound power are, for example, computed by Equation (5) and (6), or by Equation (7) and (8) below.

$$\alpha_1(n) = \text{mode}\left(\frac{Y_{2k}(n)}{Y_{1k}(n)}\right) \quad k = 1, 2, \ldots, N \tag{5}$$

$$\alpha_2(n) = \text{mode}\left(\frac{Y_{1k}(n)}{Y_{2k}(n)}\right) \quad k = 1, 2, \ldots, N \tag{6}$$

$$\alpha_1(n) = \text{median}\left(\frac{Y_{2k}(n)}{Y_{1k}(n)}\right) \quad k = 1, 2, \ldots, N \tag{7}$$

$$\alpha_2(n) = \text{median}\left(\frac{Y_{1k}(n)}{Y_{2k}(n)}\right) \quad k = 1, 2, \ldots, N \tag{8}$$

In Equations (5) to (8) above, $Y_{1k}$ (n) and $Y_{2k}$ (n) represent the BF output amplitude spectra of the microphone arrays MA1 and MA2, N represents the total number of frequency bins, k represents frequency, and $\alpha_1$ (n) and $\alpha_2$ (n) represent power correction coefficients for the respective BF outputs. In Equations (5) to (8) above, mode represents the most frequent value, and median represents the central value. Next, the respective BF outputs are corrected using the correction coefficients, and non-target area sound present in the target direction can be extracted by performing SS. Target area sound can also be extracted by performing SS of the extracted non-target area sound from the respective BF outputs. In the extraction of a non-target area sound $N_1$ (n) present in the target direction as viewed from the microphone array MA1, the product of the power correction coefficient $\alpha_2$ multiplied by the BF output $Y_2$ (n) of the microphone array MA2, is subtracted from the BF output $Y_1$ (n) of the microphone array MA1 by SS as indicated by Equation (9) below. Similarly, non-target area sound $N_2$ (n) present in the target direction as viewed from the microphone array MA2 is extracted according to Equation (10) below.

$$N_1(n)=Y_1(n)-\alpha_2(n)Y_2(n) \tag{9}$$

$$N_2(n)=Y_2(n)-\alpha_1(n)Y_1(n) \tag{10}$$

Next, the target area sound pickup signals $Z_1$ (n), $Z_2$ (n) are extracted by SS of non-target area sound from the respective BF outputs $Y_1$ (n), $Y_2$ (n), according to Equations (11) and (12). Note that in Equations (11) and (12) below, $\gamma_1$ (n), $\gamma_2$ (n) are coefficients for changing the strength of the SS.

$$Z_1(n)=Y_1(n)-\gamma_1(n)N_1(n) \tag{11}$$

$$Z_2(n)=Y_2(n)-\gamma_2(n)N_2(n) \tag{12}$$

As described above, when the technology described by JP-A No. 2014-72708 is employed, sound pickup processing can be performed for target area sound even when non-target area sound is present in the surroundings of the area that is the target.

However, even when the technology described by JP-A No. 2014-72708 is employed, when background noise is strong (for example, when the target area is a place where there are many people such as an event venue, or a place where music is playing in the surroundings), noise that cannot be fully eliminated by the target area sound pickup processing results in unpleasant abnormal sounds, such as musical noise, occurring. In conventional sound pickup devices, although these abnormal sounds are masked to some extent by target area sound, there is a possibility of annoyance to the listener when target area sound is not present, since only the abnormal sounds will be audible.

Thus a sound pickup device, program recorded medium, and method are desired that suppress pickup of background noise components even when strong background noise is present in the surroundings of a sound source of target sound.

SUMMARY

The first aspect of the present disclosure is a sound pickup device including (1) a directionality forming unit that forms directionality in the direction of a target area to output of a microphone array, (2) a target area sound extraction unit that extracts non-target area sound present in the direction of the target area from output of the directionality forming unit, and that suppresses non-target area sound components extracted from output of the directionality forming unit so as to extract target area sound, (3) a determination information computation unit that computes determination information from output of the directionality forming unit or the target area sound extraction unit, (4) an area sound determination unit that determines whether or not target area sound is present using the determination information computed by the determination information computation unit, and (5) an output unit that outputs the target area sound extracted by the target area sound extraction unit in cases in which the target area sound is determined to be present by the area sound determination unit, and that does not output the target area sound extracted by the target area sound extraction unit in cases in which the target area sound is determined not to be present by the area sound determination unit.

In the first aspect, the determination information may be an amplitude spectrum ratio sum value. In such cases, the determination information computation unit may be an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency.

Moreover, in the first aspect, the determination information may be a coherence sum value. In such cases the determination information computation unit may be a coherence computation unit that computes coherence for respective frequencies from output of the directionality forming unit, and that computes the coherence sum value by summing the coherences for each frequency.

Moreover, in the first aspect, the determination information may be an amplitude spectrum ratio sum value and a coherence sum value. In such cases, the determination information computation unit may be (1) an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency, and (2) a coherence computation unit that computes coherence for respective frequencies from output of the directionality forming unit, and that computes the coherence sum value by summing the coherences for each frequency.

The second aspect of the present disclosure is a non-transitory computer readable medium storing a program causing a computer to execute sound pickup processing. The sound pickup processing includes (1) forming directionality in the direction of a target area to output of a microphone array, (2) extracting non-target area sound present in the direction of the target area from output of the directionality forming unit, and suppressing non-target area sound components extracted from the output of the directionality forming unit so as to extract target area sound, (3) computing determination information from output of the directionality forming unit or the target area sound extraction unit, (4) determining whether or not target area sound is present using the determination information, and (5) outputting the target area sound extracted by the target area sound extraction unit in cases in which the target area sound is determined to be present by the area sound determination unit, and not outputting the target area sound extracted by the target area sound extraction unit in cases in which the target area sound is determined not to be present by the area sound determination unit.

In the second aspect, the determination information may be an amplitude spectrum ratio sum value. In such cases, the amplitude spectrum ratio sum value may be computed by computing an amplitude spectrum from output of the target area sound extraction unit, computing amplitude spectrum ratios for respective frequencies using the amplitude spectrum and an amplitude spectrum of an input signal of the microphone array, and summing the amplitude spectrum ratios for each frequency.

Moreover, in the second aspect, the determination information may be a coherence sum value. In such cases, the coherence sum value may be computed by computing coherence for respective frequencies from output of the directionality forming unit, and summing the coherences for each frequency.

Moreover, in the second aspect, the determination information may be an amplitude spectrum ratio sum value and a coherence sum value. In such cases, (1) the amplitude spectrum ratio sum value may be computed by computing an amplitude spectrum from output of the target area sound extraction unit, computing amplitude spectrum ratios for respective frequencies using the amplitude spectrum and an amplitude spectrum of an input signal of the microphone array, and summing the amplitude spectrum ratios for each frequency, and (2) the coherence sum value may be computed by computing coherence for respective frequencies from output of the directionality forming unit, and summing the coherences for each frequency.

The third aspect of the present disclosure is a sound pickup method performed by a sound pickup device that includes (1) a directionality forming unit, a target area sound extraction unit, a determination information computation unit, an area sound determination unit, and an output unit, wherein (2) the directionality forming unit forms directionality in the direction of a target area to output of a microphone array, (3) the target area sound extraction unit extracts non-target area sound present in the direction of the target area from output of the directionality forming unit, and suppresses non-target area sound components extracted from output of the directionality forming unit so as to extract target area sound, (4) the determination information computation unit computes determination information from output of the directionality forming unit or the target area sound extraction unit, (5) the area sound determination unit determines whether or not target area sound is present using the determination information computed by the determination information computation unit, and (6) the output unit outputs the target area sound extracted by the target area sound extraction unit in cases in which the target area sound is determined to be present by the area sound determination unit, and does not output the target area sound extracted by the target area sound extraction unit in cases in which the target area sound is determined not to be present by the area sound determination unit.

In the third aspect, the determination information may be an amplitude spectrum ratio sum value. In such cases, the determination information computation unit may be an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency.

Moreover, in the third aspect, the determination information may be a coherence sum value. In such cases, the determination information computation unit may be a coherence computation unit that computes coherence for respective frequencies from output of the directionality forming unit, and that computes the coherence sum value by summing the coherences for each frequency.

Moreover, in the third aspect, the determination information may be an amplitude spectrum ratio sum value and a coherence sum value. In such cases, the determination information computation unit may be (1) an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency, and (2) a coherence computation unit that computes coherence for respective frequencies from output of the directionality forming unit, and that computes the coherence sum value by summing the coherences for each frequency.

According to the present disclosure, pickup of background noise components can be suppressed even when strong background noise is present in the surroundings of a sound source of target sound.

BRIEF DESCRIPTION OF THE DRAWINGS

Exemplary embodiments of the present disclosure will be described in detail based in the following figures, wherein:

FIG. 16 is an explanatory diagram illustrating rules (such as threshold value updating rules) for when target area sound segment determination is performed by a pickup device according to the third exemplary embodiment;

DETAILED DESCRIPTION

(A) First Exemplary Embodiment

Detailed explanation follows regarding a first exemplary embodiment of a sound pick up device, program recorded medium, and method according to technology disclosed herein, with reference to the drawings.

(A-1) Configuration of First Exemplary Embodiment

Figure 1:
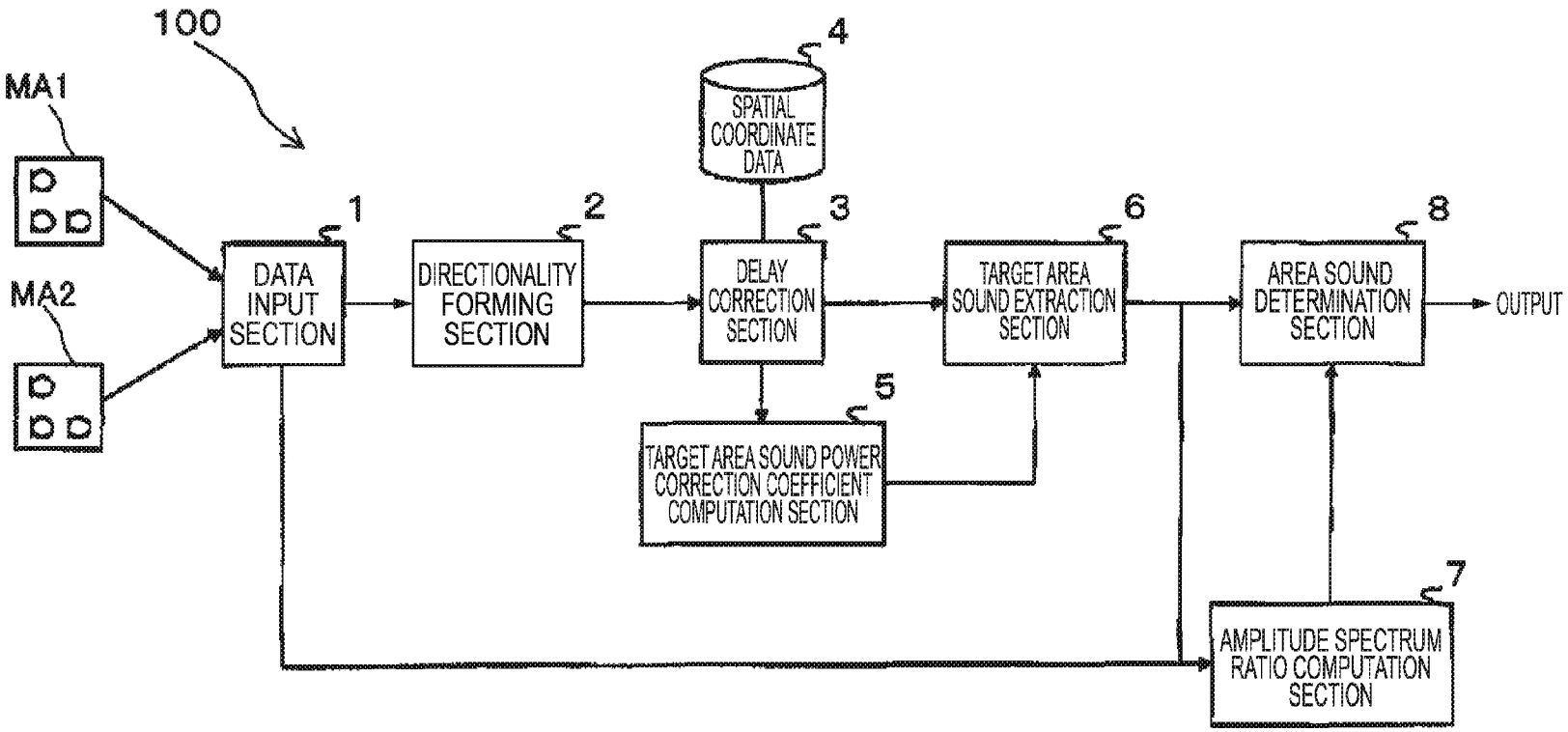
FIG. 1 is a block diagram illustrating a functional configuration of a pickup device according to a first exemplary embodiment.

FIG. 1 is a block diagram illustrating a functional configuration of a sound pickup device 100 of the first exemplary embodiment.

The sound pickup device 100 uses two microphone arrays MAL MA2 to perform target area sound pickup processing that picks up target area sound from a sound source of a target area.

Figure 4:
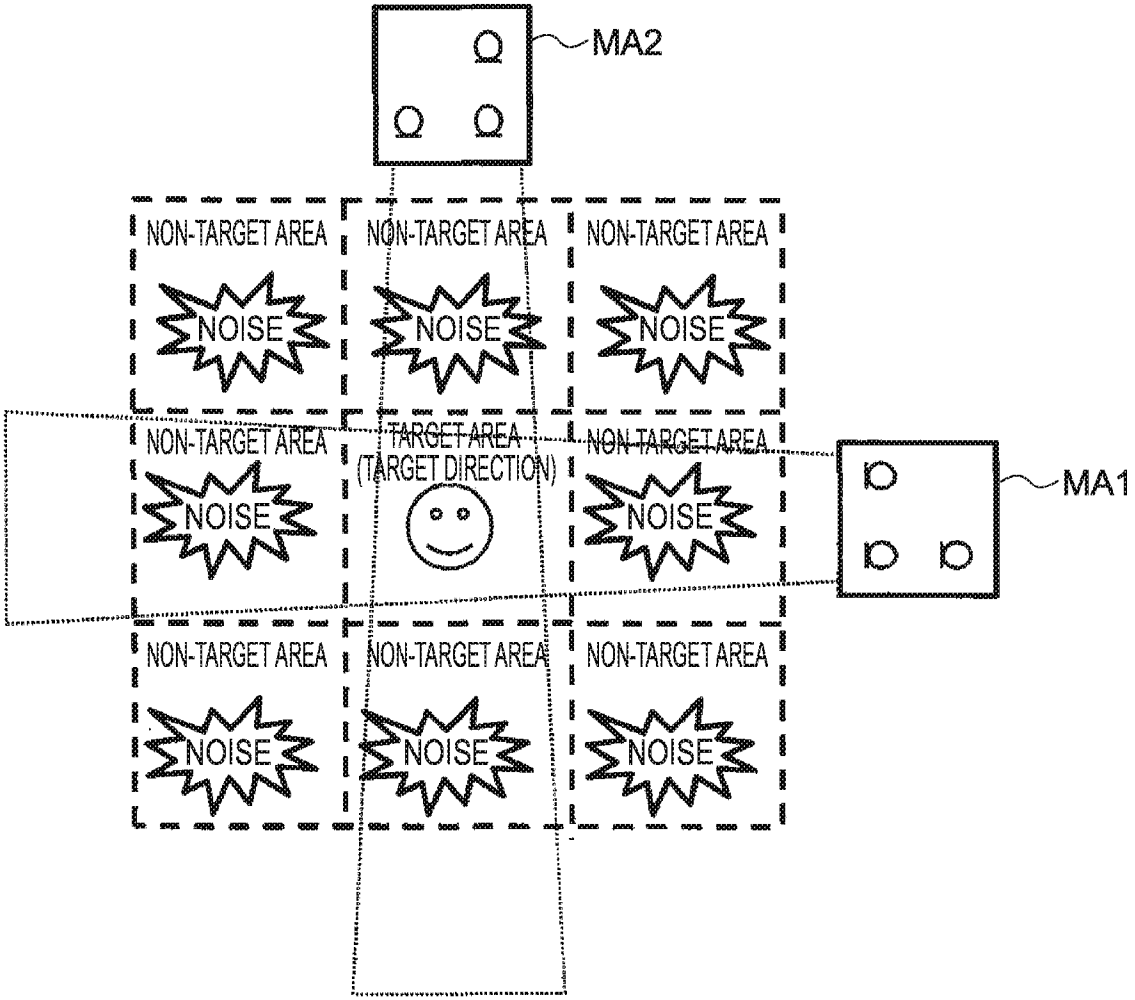
FIG. 4 is an explanatory diagram illustrating an example of positional relationships between microphone arrays and a target area according to the first exemplary embodiment.

The microphone arrays MA1, MA2 are arranged in arbitrary chosen places in a space where the target area is present. It is sufficient for the directionalities of the respective microphone arrays MA to overlap in only the target area as, for example, illustrated in FIG. 4 described above, and the positions of the microphone arrays MA with respect to the target area may, for example, be such that the microphone arrays MA face each other with the target area in between. The microphone arrays MA are configured by two or more microphones 21, and pick up audio signals using each of the microphones 21. In the present exemplary embodiment, explanation is given in which three microphones M1, M2, M3 are arranged in each of the microphone arrays MA. Namely, each microphone array MA is configured by a three channel microphone array.

Figure 2:
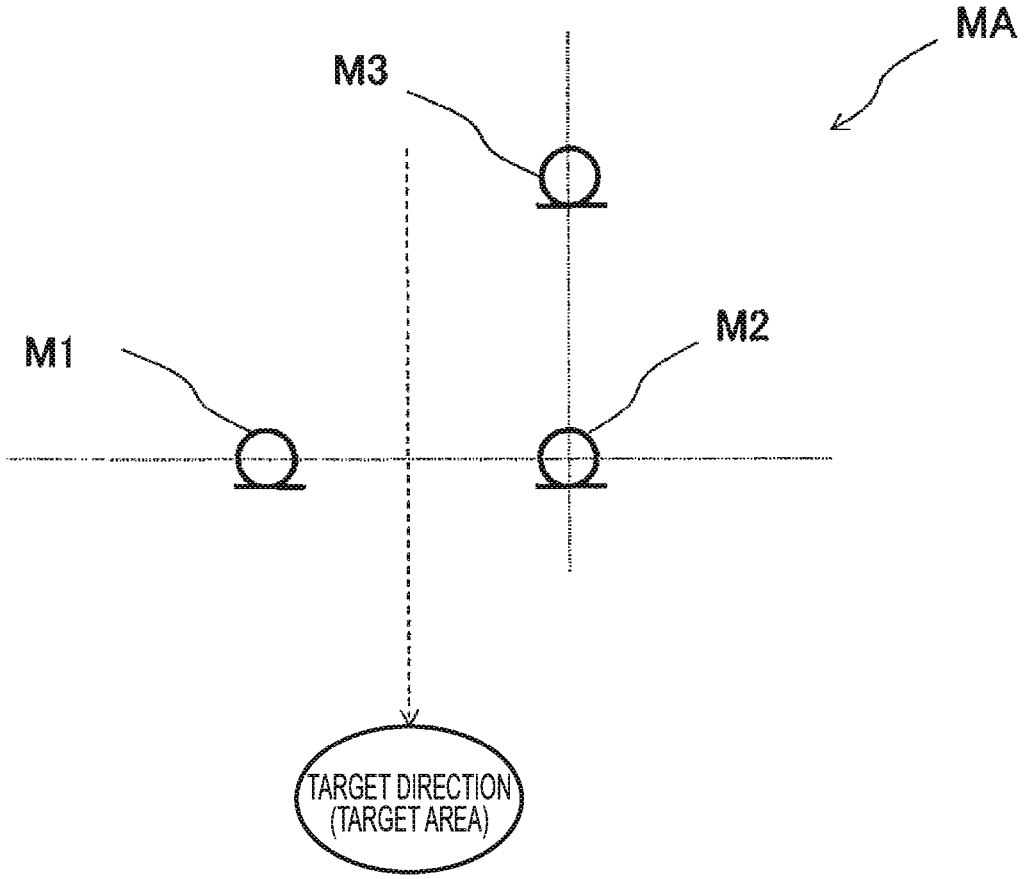
FIG. 2 is an explanatory diagram illustrating an example of positional relationships between microphones configuring a microphone array according to the first exemplary embodiment.

FIG. 2 is an explanatory diagram illustrating a positional relationship between the microphones M1, M2, M3 in each of the microphone arrays MA.

In each of the microphone arrays MA, two microphones M1, M2 are arranged so as to be square to the direction of the target area, and the microphone M3 is arranged on a straight line that is perpendicular to a straight line connecting the microphones M1, M2 and that passes through either of the microphones M1, M2, as illustrated in FIG. 2. When doing so, the distance between the microphones M3 and M2 is set equal to the distance between the microphones M1 and M2. Namely, the three microphones M1, M2, M3 are arranged so as to form vertices of an isosceles right triangle.

The sound pickup device 100 includes a data input section 1, a directionality forming section 2, a delay correction section 3, a spatial coordinate data storing section 4, a power correction coefficient computation section 5, a target area sound extraction section 6, an amplitude spectrum ratio computation section 7, and an area sound determination section 8. Explanation follows regarding detailed processing by each functional block configuring the sound pickup device 100.

The sound pickup device 100 may be entirely configured by hardware (for example, by special-purpose chips), or a part or all thereof may be configured as software (a program). The sound pickup device 100 may, for example, be configured by installing the sound pickup program of the present exemplary embodiment to a computer that includes a processor and memory.

(A-2) Operation of First Exemplary Embodiment

Next, explanation follows regarding operation of the sound pickup device 100 of the first exemplary embodiment that includes a configuration (a sound pickup method of the exemplary embodiment) as described above.

The data input section 1 performs processing that accepts supply of an analog signal of an audio signal captured by the microphone arrays MA1, MA2, converts the audio signal into a digital signal, and supplies the digital signal to the directionality forming section 2.

The directionality forming section 2 performs processing that forms directionality for the respective microphone arrays MA1, MA2 (forms directionality in the signal supplied from the microphone arrays MA1, MA2).

The directionality forming section 2 uses a fast Fourier transform to convert from the time domain into the frequency domain. In the present exemplary embodiment, the directionality forming section 2 forms a bidirectional filter using the microphones M1, M2 arranged in a row on a line orthogonal to the direction of the target area, and forms a unidirectional filter in which the blind spot faces toward the target direction using the microphones M2, M3 arranged in a row on a line parallel to the target direction.

More specifically, the directionality forming section 2 forms a bidirectional filter with $\theta_L=0$, by performing computation according to Equations (1) and (3) above on the output of the microphones M1, M2. Moreover, the directionality forming section 2 forms a unidirectional filter with $\theta_L=-\pi/2$, by performing computation according to Equations (1) and (3) above on the output of the microphones M2, M3.

Figure 3:
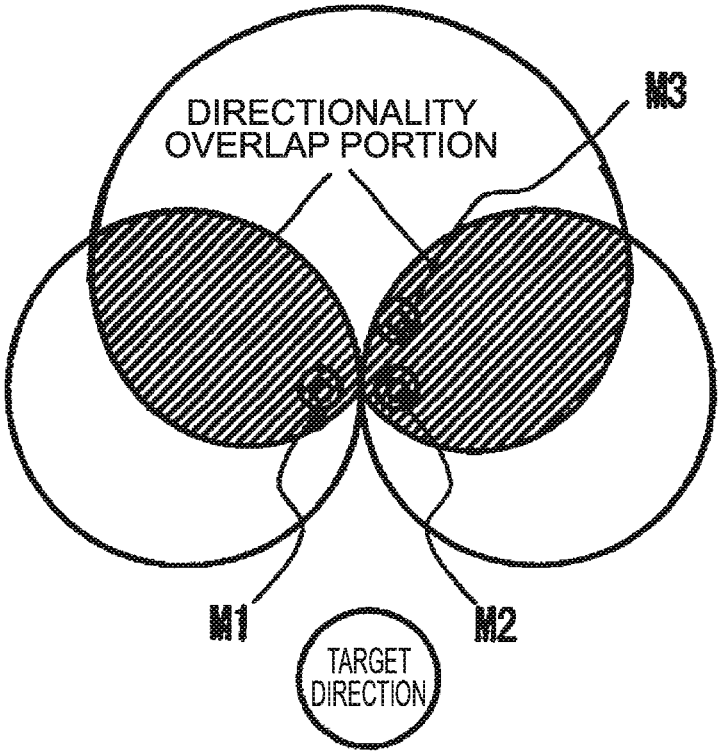
FIG. 3 is an explanatory diagram illustrating directionality formed when a pickup device according to the first exemplary embodiment employs a microphone array.

FIG. 3 illustrates directionality in the output of the microphone array MA formed by the bidirectional filter and the unidirectional filter described above. In FIG. 3, the region marked by diagonal lines indicates an overlap portion of the bidirectional filter and the unidirectional filter described above (a region in which redundant filtering occurs). As illustrated in FIG. 3, although the bidirectionality and the unidirectionality partially overlap with each other, the overlap portion can be eliminated by performing SS. More specifically, the directionality forming section 2 can eliminate the overlap portion by performing SS according to Equation (13) below. In Equation (13) below, $A_{BD}$ represents the amplitude spectrum for bidirectionality, $A_{UD}$ represents the amplitude spectrum for unidirectionality, $A_{UD'}$ represents each of the amplitude spectra of $A_{UD}$ and $A_{BD}$ after eliminating the overlap portion. Note that the directionality forming section 2 may perform flooring processing in cases in which the result of SS employing Equation (13) below, namely $A_{UD'}$, is negative.

$$A_{UD'} = \begin{cases} A_{UD} - A_{BD} \\ 0 \text{ if } A_{UD'} < 0 \end{cases} \tag{13}$$

The directionality forming section 2 can then obtain a signal Y (this signal is also referred to as the "BF output" hereafter) in which sharp directionality is only formed facing forward from the microphone array MA toward the target direction (in the direction of target sound) by SS of the two directionalities $A_{BD}$ and $A_{UD'}$ from the input signal, according to Equation (14) below. In Equation (14) below, $X_{DS}$ represents an amplitude spectrum that takes the average of each of the input signals (the outputs of the respective microphones M1, M2, M3). Moreover, in Equation (14) below, $\beta_1$ and $\beta_2$ are coefficients for adjusting the strength of the SS. The BF output based on the output of the microphone array MA1 is denoted by $Y_1$, and the BF output based on the output of the microphone array MA2 is denoted by $Y_2$, below.

$$Y=X_{DS}-\beta_1 A_{BD}-\beta_2 A_{UD'} \tag{14}$$

In the directionality forming section 2, directionality is formed in the direction of the target area by performing BF processing as described above for the respective microphone arrays MA1, MA2. In the directionality forming section 2, directionality is formed toward only the front of each of the microphone arrays MA by performing the BF processing described above, enabling the influence of reverberations wrapping around from the rear (the opposite direction to the direction of the target area as viewed from the microphone array MA) to be suppressed. Moreover, in the directionality forming section 2, non-target area sound positioned to the rear of each microphone array is suppressed in advance by performing the BF processing described above, enabling the SN ratio of the target area sound pickup processing to be improved.

The spatial coordinate data storing section 4 stores all of the positional information related to the target area (the positional information related to the range of the target area) and the positional information of each of the microphone arrays MA (the positional information of each of the microphones 21 that configure the respective microphone arrays MA). The specific format and display units of the positional information stored by the spatial coordinate data storing section 4 are not limited as long as a format is employed that enables relative positional relationships to be recognized for the target area and each of the microphone arrays MA.

The delay correction section 3 computes the delay that occurs due to differences in the distances between the target area and the respective microphone arrays MA, and performs a correction.

First, the delay correction section 3 acquires the position of the target area and the positions of the respective microphone arrays MA from the positional information stored by the spatial coordinate data storing section 4, and computes the difference in the arrival times of target area sound to the respective microphone arrays MA. Next, the delay correction section 3 adds a delay so as to synchronize target area sound at all of the microphone arrays MA simultaneously, using the microphone array MA arranged in the position furthest from the target area as a reference. More specifically, the delay correction section 3 performs processing that adds a delay to either $Y_1$ or $Y_2$ such that their phases are aligned.

The power correction coefficient computation section 5 computes correction coefficients for setting the power of target area sound components included in each of the BF outputs ($Y_1$, $Y_2$) to the same level. More specifically, the power correction coefficient computation section 5 computes the correction coefficients according to Equations (5) and (6) above or Equations (7) and (8) above.

The target area sound extraction section 6 corrects the respective BF outputs $Y_1$, $Y_2$ using the correction coefficients computed by the power correction coefficient computation section 5. More specifically, firstly the target area sound extraction section 6 corrects the respective BF outputs $Y_1$, $Y_2$ and obtains the non-target area sounds $N_1$ and $N_2$ according to Equations (9) and (10) above.

Secondly, the target area sound extraction section 6 performs SS of non-target area sound (noise) using the $N_1$ and $N_2$ that were obtained using the correction coefficients, and obtains the target area sound pickup signals $Z_1$, $Z_2$. More specifically, the target area sound extraction section 6 obtains $Z_1$ and $Z_2$ (signals in which target area sound is picked up) by performing SS according to Equations (11) and (12) above. Output in which target area sound has been extracted is referred to as area sound output hereafter.

Next, explanation follows regarding an outline of processing by the amplitude spectrum ratio computation section 7 and the area sound determination section 8. In the sound pickup device 100, an amplitude spectrum ratio (area sound output/input signal) of the output in which target area sound is extracted (referred to as the area sound output hereafter) to the input signal is computed in order to determine whether or not target area sound is present.

Figure 5:
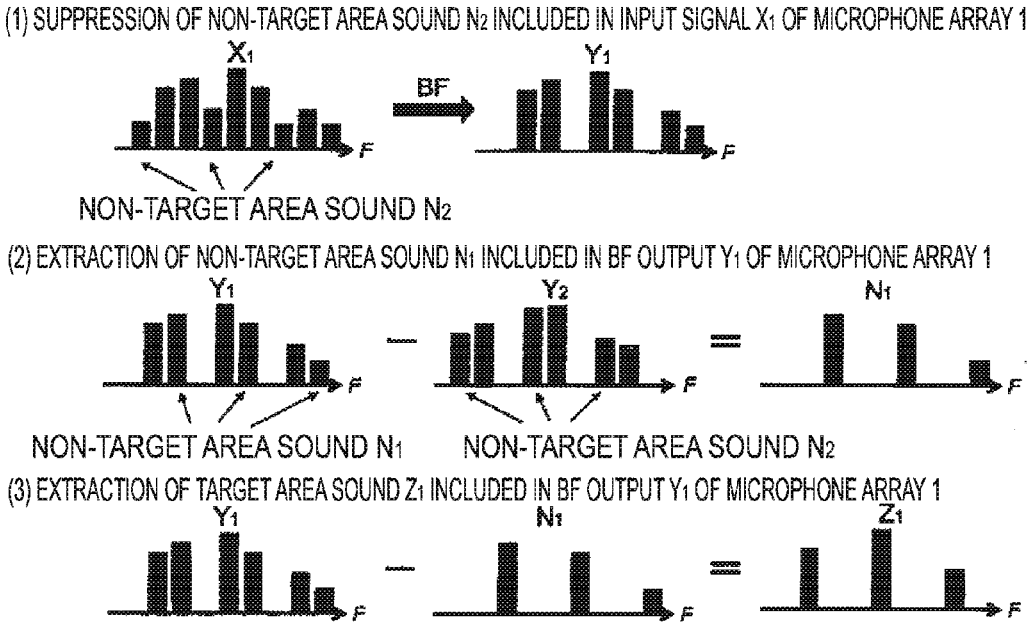
FIG. 5 is an explanatory diagram illustrating change in an amplitude spectrum between target area sound and non-target area sound in target area sound processing.

FIG. 5 is a diagram illustrating changes in the amplitude spectra of target area sound and non-target area sound in area sound pickup processing. When the sound source is present in the target area, the amplitude spectrum ratio of target area sound components is a value close to 1, since target area sound is included in both the input signal $X_1$ and the area sound output $Z_1$. On the other hand, the amplitude spectrum ratio is a small value for non-target area sound components, since non-target area sound components are suppressed in the area sound output. SS is also performed plural times in the area sound pickup processing for other background noise components, thereby somewhat suppressing the other background noise components without prior special-purpose noise suppression processing, such that their amplitude spectrum ratios are small values. However, when target area sound is not present, the amplitude spectrum ratio to the input signal is a small value over the entire range since, compared to the input signal, only weak noises residual after elimination are included in the area sound output. This characteristic unit that when all of the amplitude spectrum ratios found for each of the frequencies are summed, a large difference arises between when target area sound is present and when target area sound is not present.

Figure 6:
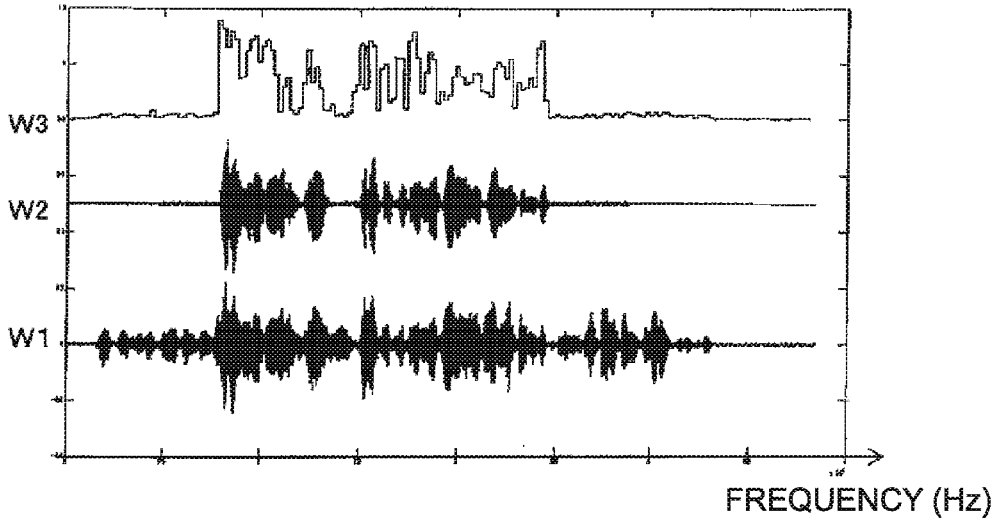
FIG. 6 is an explanatory diagram illustrating change with time in a summed value of amplitude spectrum ratios in a cases in which target area sound and two non-target area sounds are present.

Actual changes with time in the summed amplitude spectrum ratio in a case in which target area sound and two non-target area sounds are present is plotted in FIG. 6. The waveform W1 of FIG. 6 is a waveform of the input sound in which all of the sound sources are mixed together. The waveform W2 of FIG. 6 is a waveform of target area sound within the input sound. The waveform W3 of FIG. 6 illustrates the amplitude spectrum ratio sum value. As illustrated in FIG. 6, the amplitude spectrum ratio sum value is clearly large in segments in which target area sound is present. Determination is therefore made with the amplitude spectrum ratio sum value using a pre-set threshold value, and in cases in which it is determined that target area sound is not present, output processing is performed for silence without outputting the area sound output, or for sound in which the input sound gain is set low.

Next, explanation follows regarding an example of specific processing of the amplitude spectrum ratio computation section 7.

The amplitude spectrum ratio computation section 7 acquires the input signal from the data input section 1 and acquires the area sound outputs $Z_1$, $Z_2$ from the target area sound extraction section 6, and computes the amplitude spectrum ratio. For example, the amplitude spectrum ratio computation section 7 computes the amplitude spectrum ratio of the input signal to the area sound outputs $Z_1$, $Z_2$ for respective frequencies using Equations (15) and (16) below. The amplitude spectrum ratio is then summed for all frequency components using Equations (17) and (18) below, and the amplitude spectrum ratio sum value is found. In Equations (15) and (16), $W_{x1}$ is the amplitude spectrum of the input signal of the microphone array MA1 and $W_{x2}$ is the amplitude spectrum of the input signal of the microphone array MA2. Moreover, $Z_1$ is the amplitude spectrum of the area sound output in cases in which area sound pickup processing is performed with the microphone array MA1 as the main microphone array, and $Z_2$ is the amplitude spectrum of the area sound output when area sound pickup processing is performed with the microphone array MA2 as the main microphone array. $U_1$ is obtained by processing performed using Equation (17), and is amplitude spectrum ratios $R_{1i}$ for respective frequencies are added together over a range having a minimum frequency of m and a maximum frequency of n. $U_2$ is obtained by processing performed using Equation (18), and is amplitude spectrum ratios $R_{2i}$ for respective frequencies added together over a range having a minimum frequency of m and a maximum frequency of n. Herein, the frequency range that is the computation target in the amplitude spectrum ratio computation section 7 may be restricted. For example, the above computation may be performed restricted to a range of from 100 Hz to 6 kHz, in which voice information subject to computation is sufficiently included.

In the amplitude spectrum ratio computation described above, the computation is performed using either Equation (15) or Equation (16) depending on which of the microphone arrays MA is employed as the main microphone array in the area sound pickup processing. Moreover, in the summation of the amplitude spectrum ratios, the computation is performed using either Equation (17) or Equation (18) depending on which of the microphone arrays MA is employed as the main microphone array in the area sound pickup processing. More specifically, in the area sound pickup processing, Equations (15) and (17) are employed when the microphone array MA1 is employed as the main microphone array, and Equations (16) and (18) are employed when the microphone array MA2 is employed as the main microphone array.

Next, explanation follows regarding an example of specific processing by the area sound determination section 8.

The area sound determination section 8 compares the amplitude spectrum ratio sum value computed by the amplitude spectrum ratio computation section 7 against the pre-set threshold value, and determines whether or not area sound is present. The area sound determination section 8 outputs the target area sound pickup signals ($Z_1$, $Z_2$) as they are when it is determined that target area sound is present, or outputs silence data (for example, pre-set dummy data) without outputting the target area sound pickup signals ($Z_1$, $Z_2$) when it is determined that target area sound is not present. Note that the area sound determination section 8 may output a signal in which the gain of the input signal is weakened instead of outputting the silence data. Moreover, configuration may be made such that the area sound determination section 8 adds processing in which, when the amplitude spectrum ratio sum value is greater than the threshold value by a particular amount or more, target area sound will be determined to be present for several seconds afterwards, irrespective of the amplitude spectrum ratio sum value (processing corresponding to hangover functionality).

Note that the format of the signal output by the area sound determination section 8 is not limited, and may, for example, be such that the target area sound pickup signals $Z_1$, $Z_2$ are output based on the output of all of the microphone arrays MA, or such that only some of the target area sound pickup signals (for example, one out of $Z_1$ and $Z_2$) are output.

$$R_1 = \frac{W_{X_1}}{Z_1} \tag{15}$$

$$R_2 = \frac{W_{X_2}}{Z_2} \tag{16}$$

$$U_1 = \frac{1}{n-m}\sum_{i=m}^{n} R_{1_i} \tag{17}$$

$$U_2 = \frac{1}{n-m}\sum_{i=m}^{n} R_{2_i} \tag{18}$$

In the sound pickup device 100 of the first exemplary embodiment, segments in which target area sound is present and segments in which target area sound is not present are determined, and occurrence of abnormal sound is suppressed by not outputting sound that has been processed by area sound pickup processing in the segments in which target area sound is not present. Moreover, in the sound pickup device 100 of the first exemplary embodiment, determination is made with the amplitude spectrum ratio sum value using a pre-set threshold value, and when it is determined that target area sound is not present, silence is output without outputting output (area sound output) data in which target area sound is extracted, or sound is output in which the input sound gain is set low. The sound pickup device 100 of the first exemplary embodiment thereby enables the occurrence of abnormal sounds to be suppressed when target area sound is not present in an environment in which background noise is strong, by determining whether or not target area sound is present and not outputting area sound output data when it is determined that target area sound is not present.

(B) Modified Examples of First Exemplary Embodiment

Detailed description follows regarding modified examples of the first exemplary embodiment described above, with reference to the drawings.

Figure 7:
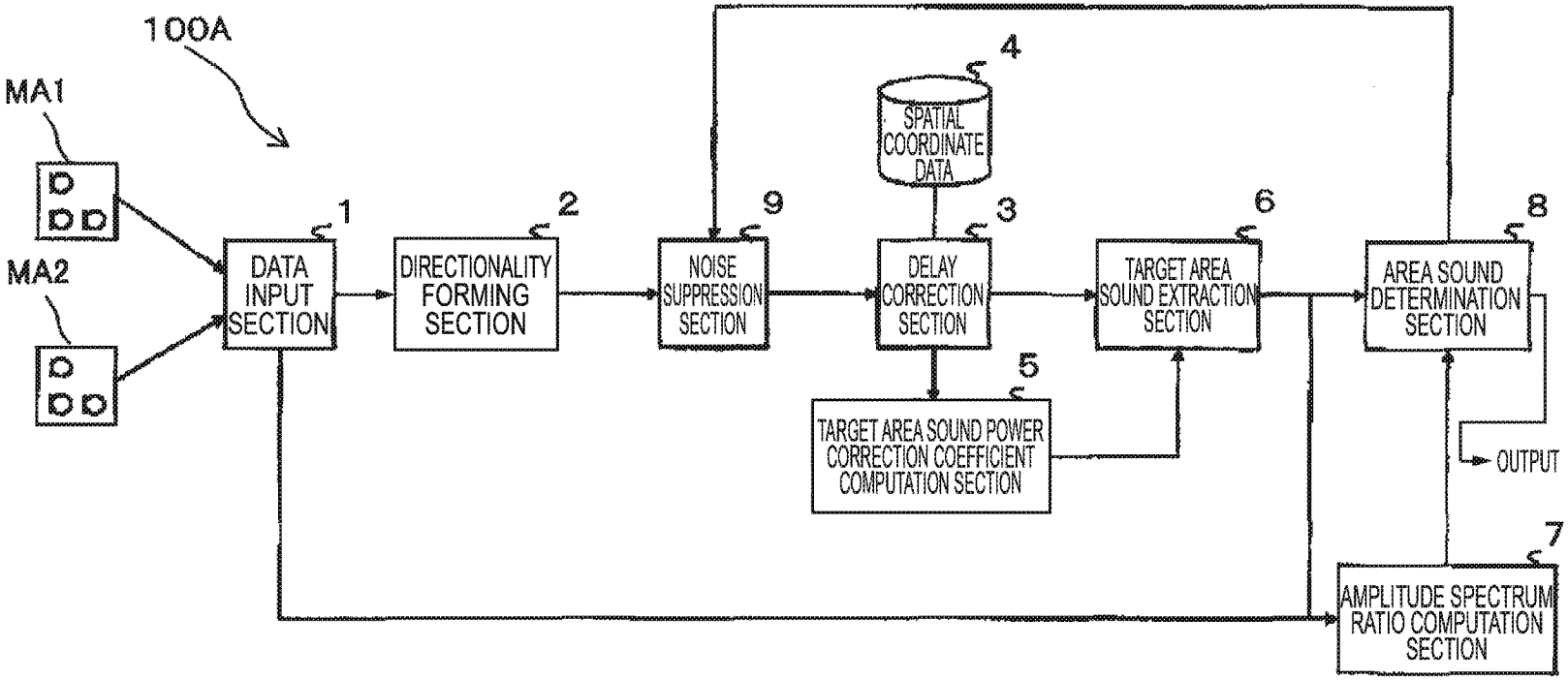
FIG. 7 is a block diagram illustrating a functional configuration of a pickup device according to a modified example of the first exemplary embodiment.

FIG. 7 is a block diagram illustrating a functional configuration of a sound pickup device 100A of a modified example of the first exemplary embodiment.

The sound pickup device 100A of the modified example of the first exemplary embodiment differs from the first exemplary embodiment in that a noise suppression section 9 is added. The noise suppression section 9 is inserted between the directionality forming section 2 and the delay correction section 3.

The noise suppression section 9 uses the determination result (a detection result indicating segments in which target area sound is present) of the area sound determination section 8 to perform suppression processing on noise (sounds other than target area sound) for the respective BF outputs $Y_1$, $Y_2$ output from the directionality forming section 2 (the BF output results for the microphone arrays MA1, MA2), and supplies the processing result to the delay correction section 3.

The noise suppression section 9 adjusts the noise suppression processing by employing the result of the area sound determination section 8 similarly to in voice segment detection (known as voice activity detection; referred to as VAD hereafter). Ordinarily, when performing noise suppression in a sound pickup device, the input signal is determined as voice segments or noise segments using VAD, and a filter is formed by learning from the noise segments. In cases in which non-target area sound in the input signal is a voice, although ordinary VAD processing determines as voice segments, the determination made by the area sound determination section 8 of the present exemplary embodiment treats sounds other than target area sound as noise even if they are voices. The noise suppression section 9 therefore uses the determination result of the area sound determination section 8 to determine target area sound segments (segments in which target area sound is present), and non-target area sound segments (segments in which only non-target area sound is present without the presence of target area sound). For example, the noise suppression section 9 may recognize a sound-containing segment amongst segments other than the target area sound segments as a non-target area sound segment. The noise suppression section 9 then recognizes the non-target area sound segment as a noise segment, and performs processing for filter learning and filter gain adjustment similarly to in existing VAD.

The noise suppression section 9 may, for example, perform further filter learning when it is determined that target area sound is not present. Moreover, when target area sound is not present, the noise suppression section 9 may strengthen the filter gain compared to times in which target area sound is present.

The noise suppression section 9 employs the processing result immediately preceding in time series (the $n-1^{th}$ processing result in time series) as the determination received from the area sound determination section 8; however, configuration may be made such that noise suppression processing is performed by receiving the current processing result (the $n^{th}$ processing result in time series), and area sound pickup processing is performed again. Various methods such as SS, Wiener filtering, or minimum mean square error-short time spectrum amplitude (MMSE-STSA) may be employed as the method of noise suppression processing.

In the modified example of the first exemplary embodiment, target area sound pickup may be performed more precisely than in the ordinary first exemplary embodiment due to provision of the noise suppression section 9.

Moreover, in the noise suppression section 9, noise suppression that is more suited to pickup of target area sound than conventional noise suppression processing may be performed since noise suppression processing can be performed using the determination results of the area sound determination section 8 (the non-target area sound segments).

(C) Second Exemplary Embodiment

Detailed explanation follows regarding a second exemplary embodiment of a sound pickup device, program recorded medium, and method of technology disclosed herein, with reference to the drawings.

(C-1) Configuration of Second Exemplary Embodiment

Figure 8:
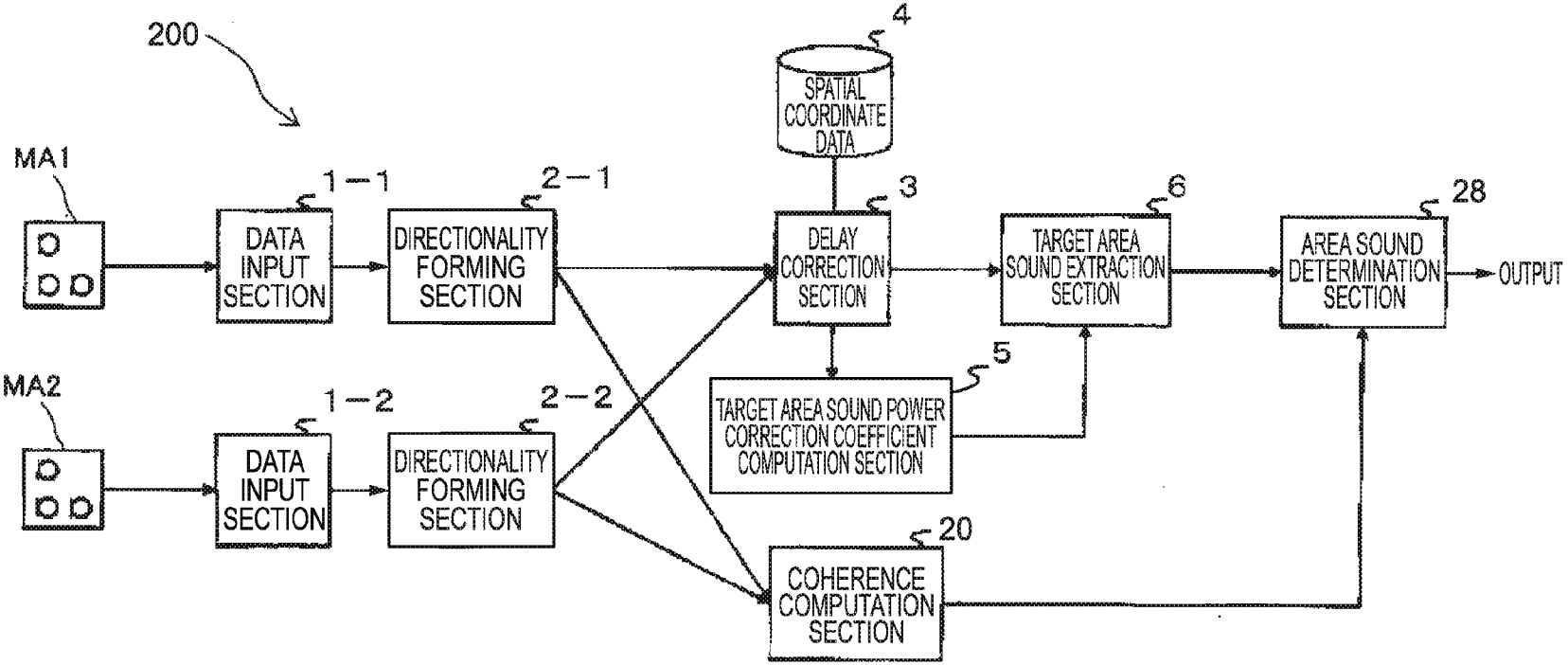
FIG. 8 is a block diagram illustrating a functional configuration of a pickup device according to the second exemplary embodiment.

FIG. 8 is a block diagram illustrating a functional configuration of a sound pickup device 200 of the second exemplary embodiment.

The sound pickup device 200 of the second exemplary embodiment includes data input sections 1 (1-1, 1-2) and directionality forming sections 2 (2-1, 2-2), and differs from the sound pickup device 100 of the first exemplary embodiment in that a coherence computation section 20 is provided in place of the amplitude spectrum ratio computation section 7, and an area sound determination section 28 is provided in place of the area sound determination section 8. Note that the same reference numerals are allocated for parts common to the first exemplary embodiment, and explanation thereof is omitted.

(C-2) Operation of Second Exemplary Embodiment

The data input sections 1-1, 1-2 perform processing to receive a supply of analog signals of audio signals captured by the microphone arrays MA1 and MA2 respectively, convert the analog signals into digital signals, and supply the digital signals to the directionality forming sections 2-1 and 2-2 respectively.

The directionality forming sections 2-1, 2-2 perform processing to form directionality for the microphone arrays MA1 and MA2 respectively (to form directionality in the signals supplied from the microphone arrays MA1 and MA2).

The directionality forming sections 2-1 and 2-2 each perform conversion from the time domain into the frequency domain using a fast Fourier transform. In the present exemplary embodiment, each of the directionality forming sections 2-1 and 2-2 forms a bidirectional filter using the microphones M1 and M2 that are arranged in a row on a line perpendicular to the direction of the target area, and forms a unidirectional filter facing toward the blind spot along the target direction using the microphones M2 and M3 that are arranged in a row on a line parallel to the target direction.

Next, explanation follows regarding an outline of processing by the coherence computation section 20 and the area sound determination section 28.

In the sound pickup device 200, the coherence computation section 20 computes the coherence between the respective BF outputs in order to determine whether or not target area sound is present. Coherence is a characteristic quantity indicating relatedness between two signals, and takes a value of from 0 to 1. When the value is closer to 1, this indicates a stronger relationship between the two signals.

Figure 20:
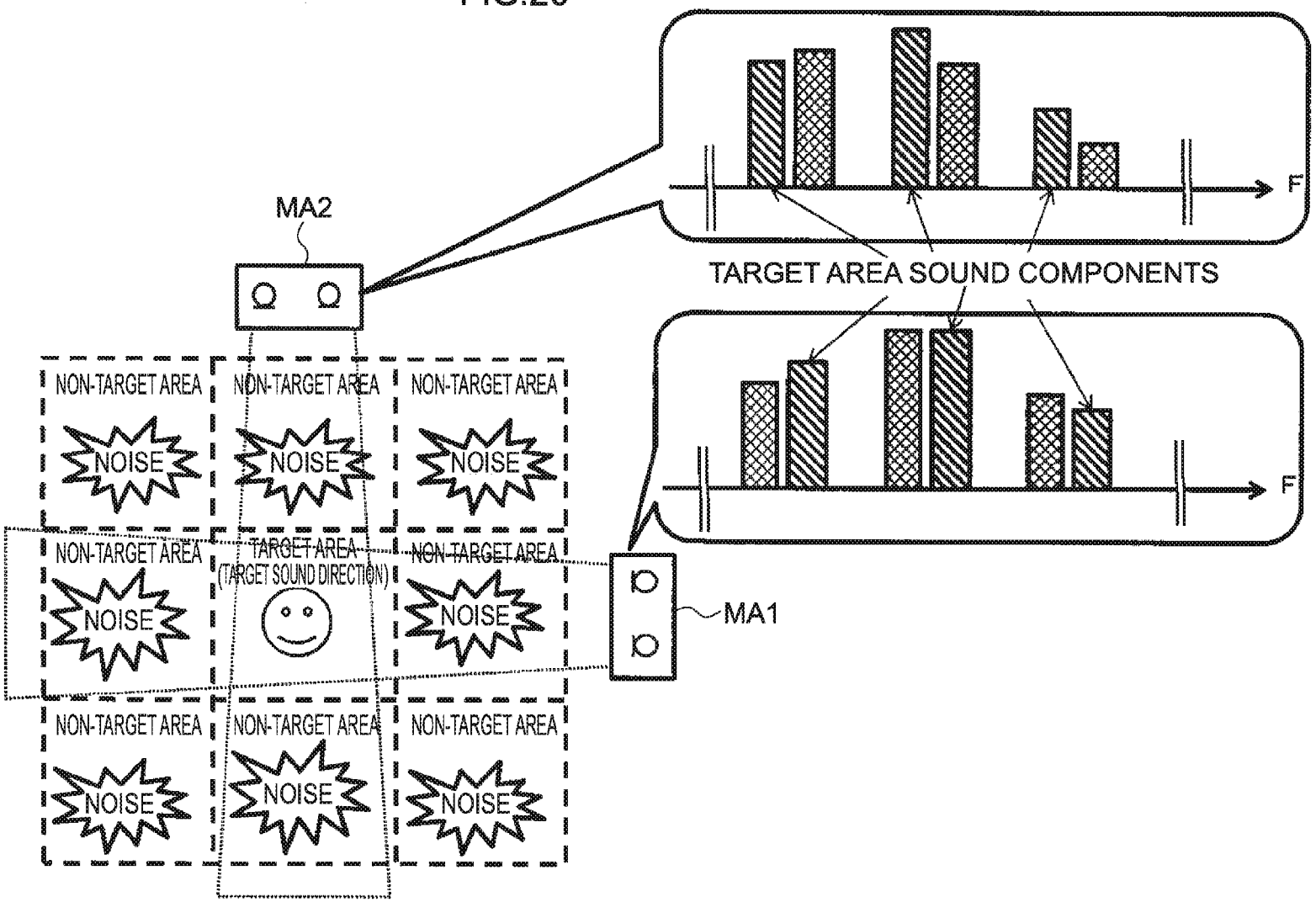
FIG. 20 is an explanatory diagram regarding a configuration example for a case in which directionality faces a target area from separate directions due to a beamformer (BF) having two microphone arrays in a conventional pickup device.

For example, when a sound source is present in the target area as illustrated in FIG. 20, the coherence of target area sound components becomes high since the target area sound is included common to both BF outputs. Conversely, when no target area sound is present in the target area (when no sound source is present), the coherence is low since each non-target area sound included in each of the BF outputs is different. Moreover, since the two microphone arrays MA1 and MA2 are separated, the background noise components in the respective BF outputs are also different, and coherence is low. This characteristic means that when the coherences found for respective frequencies are summed, a large difference arises between when target area sound is present and when target area sound is not present.

Figure 9:
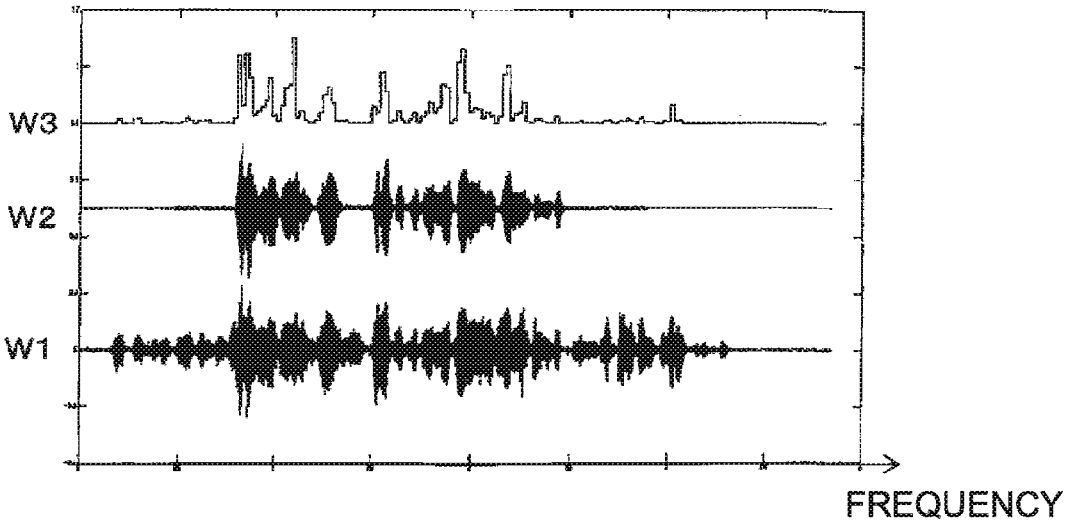
FIG. 9 is an explanatory diagram illustrating change with time in a coherence sum value of input sound in which target area sound and non-target area sound are present.

Actual changes with time in the summed value of the coherences when target area sound and two non-target area sounds are present are illustrated in FIG. 9. The waveform W1 of FIG. 9 is a waveform of input sound in which all of the sound sources are mixed together. The waveform W2 of FIG. 9 is a waveform of target area sound in the input sound. The waveform W3 of FIG. 9 indicates the coherence sum value. As illustrated in FIG. 9, the coherence sum value is clearly large in the segments in which target area sound is present. Therefore, in the sound pickup device 200, the area sound determination section 28 makes determination with the coherence sum value using a pre-set threshold value, and in cases in which it is determined that target area sound is not present, processing is performed to output silence without outputting the output data in which target area sound is extracted, or to output sound in which the input sound gain is set low.

Next, explanation follows regarding an example of specific processing by the coherence computation section 20.

The coherence computation section 20 acquires the BF outputs $Y_1$ and $Y_2$ of the respective microphone arrays from the directionality forming sections 2-1 and 2-2, and computes the coherence for each of the frequencies so as to find the coherence sum value by summing the coherence for all of the frequencies.

For example, the coherence computation section 20 uses Equation (19) below to perform the coherence computation according to $Y_1$ and $Y_2$. The coherence computation section 20 then sums the computed coherence according to Equation (20) below.

The coherence computation section 20 employs the phase between the respective input signals of the microphone arrays MA as the phase information of the BF outputs $Y_1$ and $Y_2$ that are needed when computing the coherence. When this is performed, the coherence computation section 20 may be limited to a frequency range. For example, the coherence computation section 20 may acquire the phase between the input signals of the microphone arrays MA while limited to a frequency range in which voice information is sufficiently included (for example, a range of from approximately 100 Hz to approximately 6 kHz).

Note that in Equations (19) and (20) below, C represents the coherence. Moreover, in Equations (19) and (20) below, $P_{y1y2}$ represents the cross spectrum of the BF outputs $Y_1$ and $Y_2$ from the respective microphone arrays. Moreover, in Equations (19) and (20) below, $P_{y1y1}$ and $P_{y2y2}$ represent the power spectra of $Y_1$ and $Y_2$, respectively. Moreover, in Equation (19) and (20) below, m and n represent a minimum frequency and a maximum frequency, respectively. Moreover, in Equations (19) and (20) below, H represents the summed value of coherence for each frequency.

The coherence computation section 20 may employ past information as the $Y_1$ and the $Y_2$ employed to compute the cross spectrum and the power spectra. In such cases, $Y_1$ and $Y_2$ can be respectively acquired using Equation (21) and Equation (22) below. In Equations (21) and (22), $\alpha$ is a freely set coefficient that establishes to what extent past information is employed, and the value thereof is set in the range of from 0 to 1. Note that $\alpha$ needs to be set in the coherence computation section 20 after acquiring an optimum value by performing experiments or the like in advance.

$$C = \frac{|P_{y_1 y_2}|^2}{P_{y_1 y_1} P_{y_2 y_2}} \tag{19}$$

$$H = \frac{1}{n-m} \sum_{i=m}^{n} C_i \tag{20}$$

$$Y_1(t) = \alpha Y_1(t) + (1-\alpha) Y_1(t-1) \tag{21}$$

$$Y_2(t) = \alpha Y_2(t) + (1-\alpha) Y_2(t-1) \tag{22}$$

Next, explanation follows regarding an example of specific processing by the area sound determination section 28.

The area sound determination section 28 compares the coherence sum value computed by the coherence computation section 20 against the pre-set threshold value and determines whether or not the area sound is present. When it is determined that target area sound is present, the area sound determination section 28 outputs the target area sound pickup signals ($Z_1$, $Z_2$) as they are, and when it is determined that target area sound is not present, the area sound determination section 8 outputs silence data (for example, pre-set dummy data) without outputting the target area sound pickup signals ($Z_1$, $Z_2$). Note that the area sound determination section 28 may output data in which the input signal gain is weakened instead of the silence data. Moreover, configuration may be made such that the area sound determination section 28 adds processing in which, when the coherence sum value is greater than the threshold value by a particular amount or more, target area sound will be determined to be present for several seconds afterwards irrespective of the coherence sum value (processing corresponding to hangover functionality).

Note that the format of the signal output by the area sound determination section 28 is not limited, and may, for example, be such that the target area sound pickup signals $Z_1$, $Z_2$ are output based on the output of all of the microphone arrays MA, or such that only some of the target area sound pickup signals (for example, one out of $Z_1$ and $Z_2$) are output.

In the sound pickup device 200 of the second exemplary embodiment, segments in which target area sound is present and segments in which target area sound is not present are determined, and occurrence of abnormal sound is suppressed by not outputting sound that has been processed by area sound pickup processing in the segments in which target area sound is not present. Moreover, in the sound pickup device 200 of the second exemplary embodiment, determination is made with the coherence sum value using a pre-set threshold value, and when it is determined that target area sound is not present, silence is output without outputting area sound output data in which target area sound is extracted, or sound is output in which the input sound gain is set low. The sound pickup device 200 of the second exemplary embodiment thereby enables the occurrence of abnormal sounds to be suppressed when target area sound is not present in an environment in which background noise is strong, by determining whether or not target area sound is present and not outputting area sound output data when target area sound is not present.

(D) Modified Example of the Second Exemplary Embodiment

Figure 10:
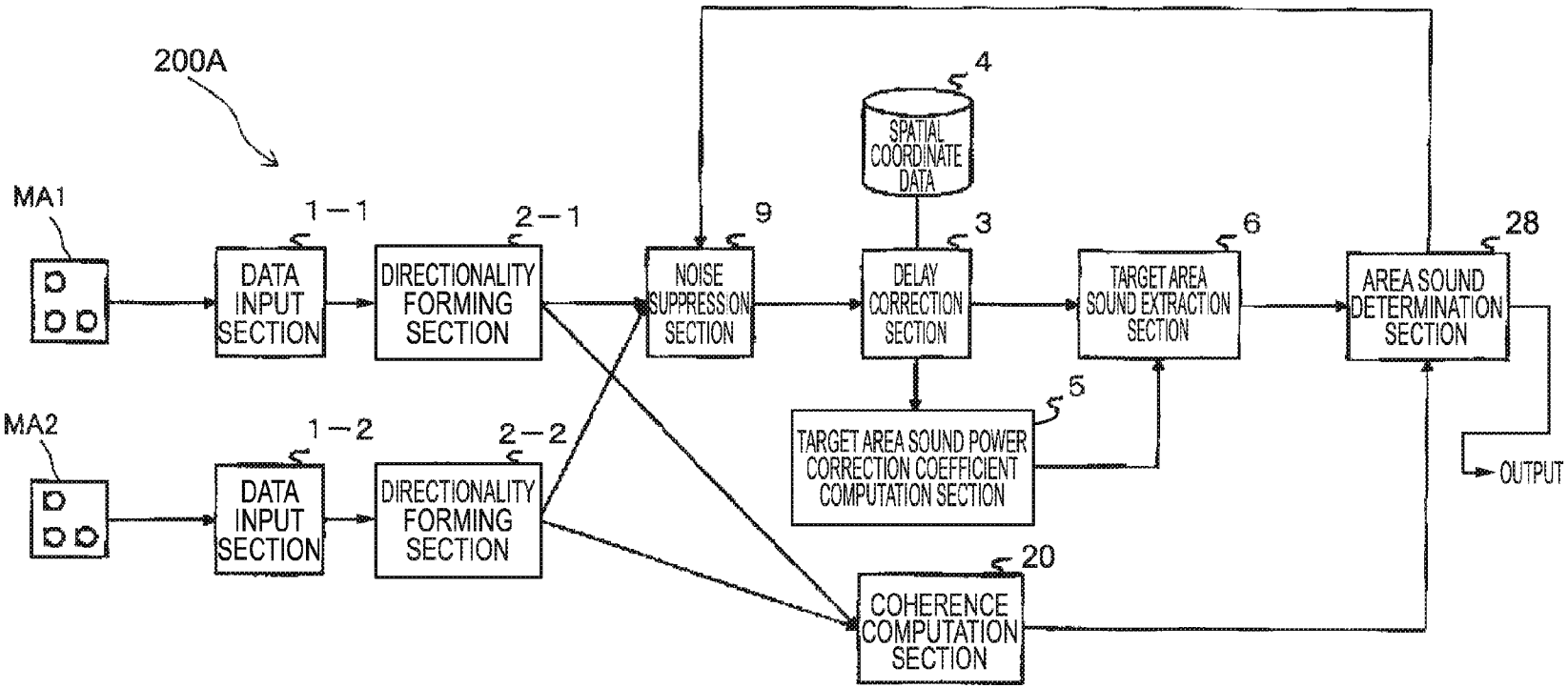
FIG. 10 is a block diagram illustrating a functional configuration of a pickup device according to a modified example of the second exemplary embodiment.

FIG. 10 is a block diagram illustrating a functional configuration of a sound pickup device 200A of a modified example of the second exemplary embodiment.

The sound pickup device 200A of the modified example of the second exemplary embodiment differs from the second exemplary embodiment in that a noise suppression section 9 is added. The noise suppression section 9 is inserted between the directionality forming sections 2-1, 2-2 and the delay correction section 3.

The noise suppression section 9 uses the determination results (detection results indicating segments in which target area sound is present) of the area sound determination section 28 to perform suppression processing on noise (sounds other than target area sound) for the respective BF outputs $Y_1$, $Y_2$ output from the directionality forming sections 2-1, 2-2 (the BF output results of the microphone arrays MA1, MA2), and supplies the processing results to the delay correction section 3.

In other respects, parts common to the sound pickup device 200 of the second exemplary embodiment or the sound pickup device 100A of the modified example of the first exemplary embodiment are allocated the same reference numerals, and explanation thereof is omitted.

In the modified example of the second exemplary embodiment, pickup of target area sound can be performed with higher precision than in the second exemplary embodiment due to the inclusion of the noise suppression section 9.

Moreover, in the noise suppression section 9, noise suppression processing can be performed using the determination result of the area sound determination section 28 (non-target area sound segments), enabling noise suppression to be performed that is more suited to pickup of target area sound than conventional noise suppression processing.

(E) Third Exemplary Embodiment

Detailed description follows regarding a third exemplary embodiment of a sound pickup device, program recorded medium, and method of technology disclosed herein, with reference to the drawings.

(E-1) Configuration of Third Exemplary Embodiment

Figure 11:
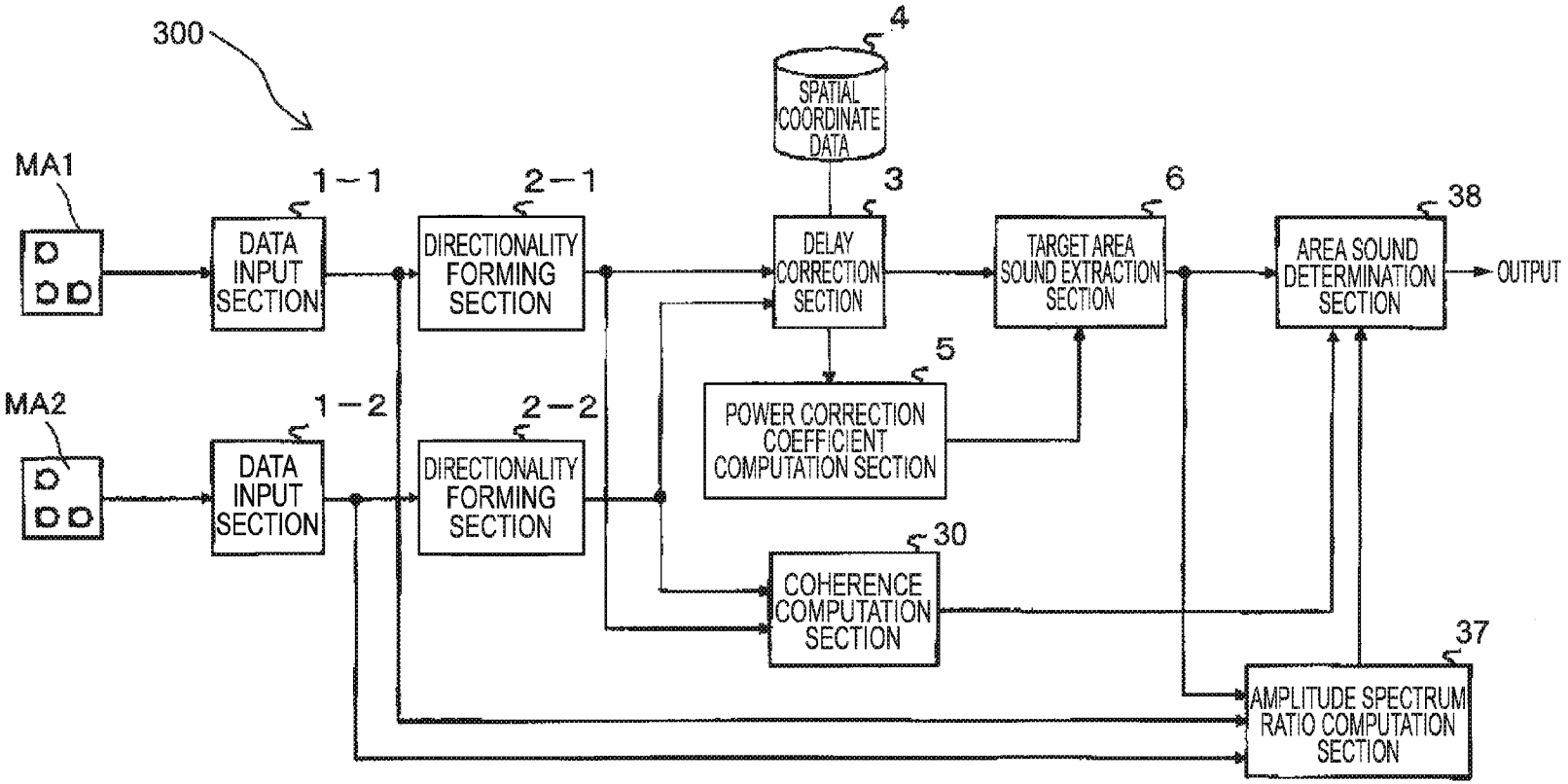
FIG. 11 is a block diagram illustrating a functional configuration of a pickup device according to a third exemplary embodiment.

FIG. 11 is a block diagram illustrating a functional configuration of a sound pickup device 300 of the third exemplary embodiment.

The sound pickup device 300 includes data input sections 1 (1-1, 1-2), and a directionality forming sections 2 (2-1, 2-2), and differs from the sound pickup device 100 of the first exemplary embodiment in that an amplitude spectrum ratio computation section 37 and a coherence computation section 30 are provided in place of the amplitude spectrum ratio computation section 7, and an area sound determination section 38 is provided in place of the area sound determination section 8. Note that common same reference numerals are allocated for parts common to the first exemplary embodiment or the second exemplary embodiment, and explanation thereof is omitted.

(E-2) Operation of Third Exemplary Embodiment

Next, explanation follows regarding an outline of processing by the amplitude spectrum ratio computation section 37, the coherence computation section 30, and the area sound determination section 38.

The area sound determination section 38 determines segments in which target area sound is present (referred to as "target area sound segments" hereafter) and segments in which target area sound is not present (referred to as "non-target area sound segments" hereafter), and suppresses occurrence of abnormal sound by not outputting sound that has been processed by area sound pickup processing in the non-target area sound segments. Note that in the present exemplary embodiment, explanation is given in which noise (non-target area sound) always occurs. In order to determine whether or not target area sound is present, the area sound determination section 38 employs two kinds of characteristic quantities: the amplitude spectrum ratio (the area sound output/input signals) of the output (referred to as the "area sound pickup output" hereafter) after area sound pickup processing to the input signal, and the coherence between the respective BF outputs.

FIG. 5 is an explanatory diagram illustrating changes in the amplitude spectrum between target area sound and non-target area sound in the area sound pickup processing. FIG. 5 is common to the first exemplary embodiment.

When a sound source is present in the target area, target area sound is common to both the input signal $X_1$ and the area sound output $Z_1$, such that the amplitude spectrum ratio of target area sound components is a value close to 1. Moreover, non-target area sound components are suppressed in the area sound output giving amplitude spectrum ratios having small values. SS is also performed plural times in the area sound pickup processing for other background noise components, thereby suppressing the other background noise components somewhat without prior performance of special-purpose noise suppression processing, so as to give amplitude spectrum ratios having small values. On the other hand, when target area sound is not present, the amplitude spectrum ratio is a small value compared to the input signal over the entire range since only weak noises residual after elimination are included in the area sound output. This characteristic means that when all of the amplitude spectrum ratios found for each of the frequencies are summed, a large difference arises between when target area sound is present and when target area sound is not present.

Figure 12:
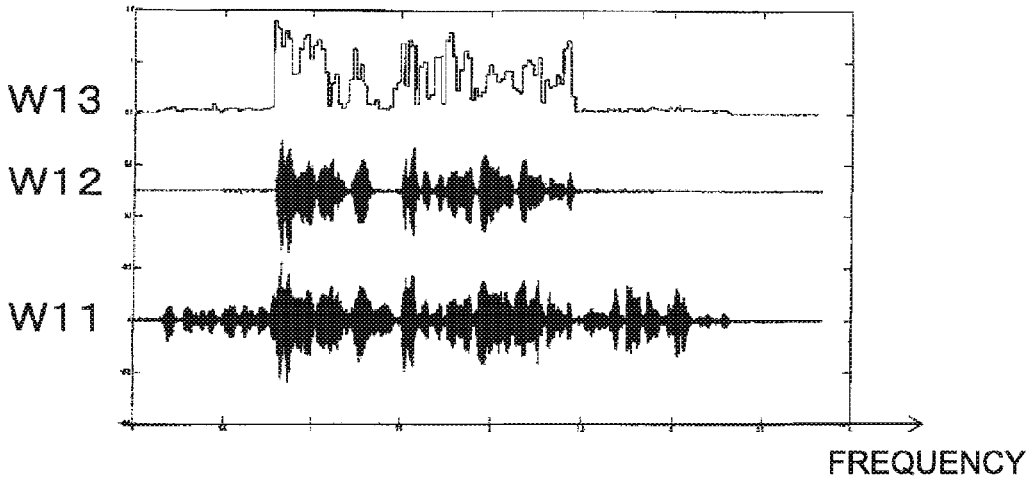
FIG. 12 is an explanatory diagram illustrating change with time in an amplitude spectrum ratio sum value (case 1: no reverberation) computed by a pickup device according to the third exemplary embodiment.

Actual changes with time in the summed value of the amplitude spectrum ratio in a case in which a target area sound and two non-target area sounds are present are plotted in FIG. 12. The waveform W11 of FIG. 12 is a waveform of the input sound in which all of the sound sources are mixed together. The waveform W12 of FIG. 12 is a waveform of target area sound in the input sound. The waveform W13 of FIG. 12 illustrates the amplitude spectrum ratio sum value. As illustrated in FIG. 12, the amplitude spectrum ratio sum value is clearly large in segments in which target area sound is present.

Figure 13:
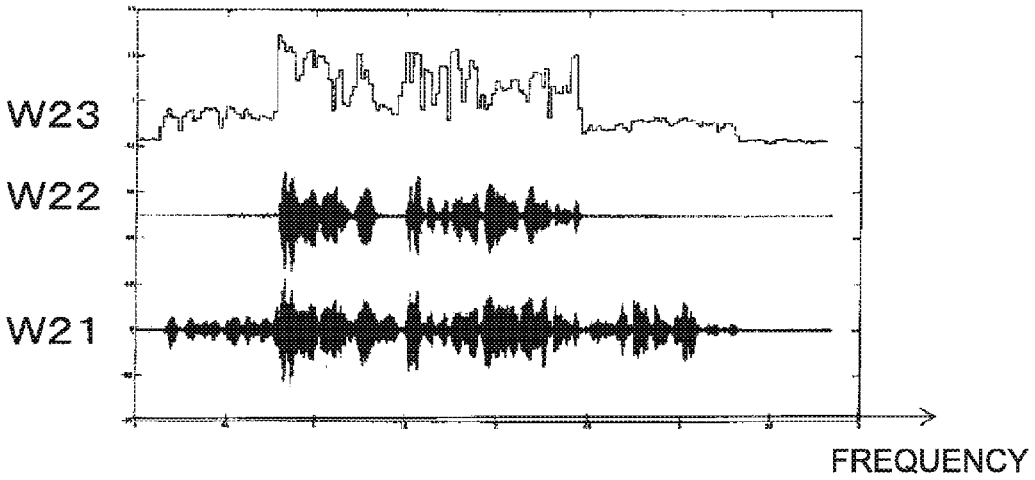
FIG. 13 is an explanatory diagram illustrating change with time in an amplitude spectrum ratio sum value (case: with reverberation) computed by a pickup device according to the third exemplary embodiment.

Although FIG. 12 illustrates the amplitude spectrum ratio sum value in an environment in which there is virtually no reverberation, changes in the amplitude spectrum ratio sum value with time in an environment in which there are reverberations are like those illustrated in FIG. 13.

The waveform W21 of FIG. 13 is a waveform of the input sound in which all of the sound sources are mixed together. The waveform W22 of FIG. 13 is a waveform of target area sound in the input sound. The waveform W23 of FIG. 13 indicates the amplitude spectrum ratio sum value. In the presence of reverberations as in FIG. 13, it is possible that reflected non-target area sound will be simultaneously included in the directionality of each microphone array. In such situations, the non-target area sound may be regarded as target area sound, and the non-target area sound remains in the target area sound output. This results in the summed value of the amplitude spectrum ratio also being large in non-target area sound segments as illustrated in FIG. 13. Therefore the value of the threshold value needs to be set higher than in an environment with no reverberations.

Moreover, it is preferable to measure the strength of reverberations in each area in advance in order to set the threshold value appropriately when determining whether or not target area sound is present based on the amplitude spectrum ratio sum value. Therefore, in the present exemplary embodiment, the coherence between the respective BF outputs is also employed to determine whether or not target area sound is present. Coherence is a characteristic quantity indicating relatedness between two signals, and takes a value of from 0 to 1. When the value is closer to 1, this indicates a stronger relationship between the two signals. When a sound source is present in the target area, the coherence of target area sound components becomes high since the target area sound is included common to both BF output signals. Conversely, when no target area sound is present, the coherence is low since non-target area sounds included in the respective BF outputs are different from each other. Moreover, since the two microphone arrays MA1 and MA2 are separated, the background noise components in the respective BF outputs are also different, and coherence is low. This characteristic means that when all of the coherences found for respective frequencies are summed, a large difference arises between when target area sound is present and when target area sound is not present.

Figure 14:
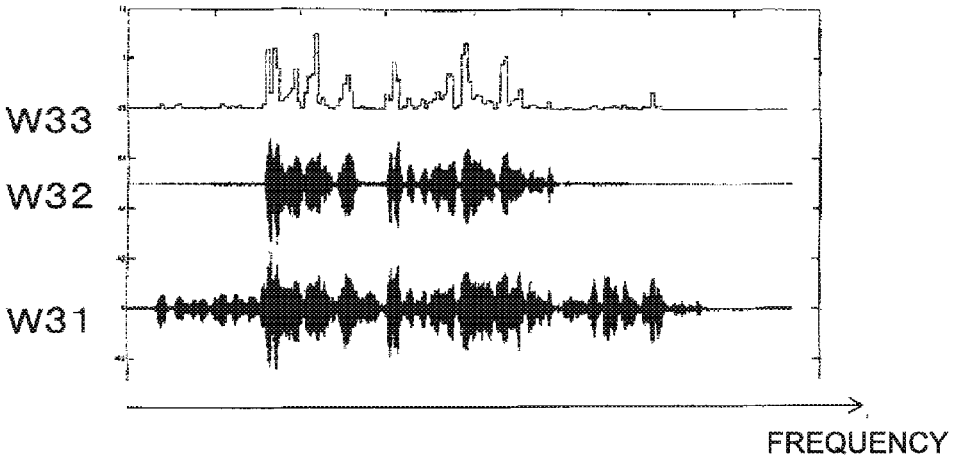
FIG. 14 is an explanatory diagram illustrating change with time in a coherence sum value (case: no reverberation) computed by a pickup device according to the third exemplary embodiment.
Figure 15:
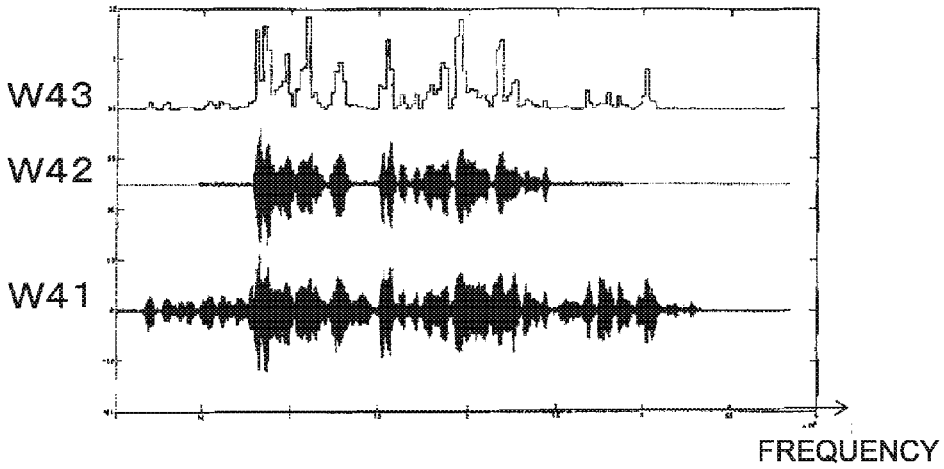
FIG. 15 is an explanatory diagram illustrating change with time in a coherence sum value (case: with reverberation) computed by a pickup device according to the third exemplary embodiment.

Actual changes with time in the summed value of the coherences in a case in which there is a target area sound and two non-target area sounds present are plotted in FIG. 14 and FIG. 15. FIG. 14 illustrates changes in the coherence sum value with time in an environment with virtually no reverberation. FIG. 15 illustrates changes in the coherence sum value with time in the presence of reverberation.

The waveforms W31 and W41 of FIG. 14 and FIG. 15 are both waveforms of the input sound in which all of the sound sources are mixed together. The waveforms W32 and W42 of FIG. 14 and FIG. 15 are both waveforms of target area sound in the input sound. The waveforms W33 and W43 of FIG. 14 and FIG. 15 both indicate the coherence sum value.

According to FIG. 14 and FIG. 15, the coherence sum value is clearly large in target area sound segments. When FIG. 12 to FIG. 15 are compared, it is clear that the coherence sum value is inferior to the amplitude spectrum ratio sum value for detection of weak target area sound segments, but that reverberation has less impact on the coherence sum value.

The area sound determination section 38 utilizes characteristics of the coherence sum value as described above, and updates the threshold value of the amplitude spectrum ratio sum value (the threshold value employed in the determination of target area sound segments) in the presence of reverberation. The timing at which the area sound determination section 38 updates the threshold value is established, for example, by determining the amplitude spectrum ratio sum value and the coherence sum value using respective pre-set threshold values, and then comparing the two determination results. Then, in cases in which the two determination results are the same, if the segment is a target area sound segment, the area sound determination section 38 outputs the area sound output as is, or if the segment is a non-target area sound segment, the area sound determination section 38 outputs silence without outputting the area sound output data or outputs sound in which the input sound gain is set low, in accordance with the result. However, when the two determinations are different from each other, there is a possibility that mis-determination occurred due to reverberation.

The area sound determination section 38 uses past determination result history (history of finalized determination results) to make determination in cases in which a target area sound segment was determined based on the amplitude spectrum ratio sum value and a non-target area sound segment was determined based on the coherence sum value. In the present exemplary embodiment, the area sound determination section 38 prioritizes determination with the amplitude spectrum ratio sum value when the same result is obtained less than a certain number of times; however, when such determination continues for the certain number of times or more, it is conceivable that the threshold value of the amplitude spectrum ratio sum value is highly likely to be exceeded in a non-target area sound segment due to the effect of reverberation, and the threshold value of the amplitude spectrum ratio sum value is therefore raised. After this, the area sound determination section 38 then re-performs the determination using the amplitude spectrum ratio sum value.

Moreover, in cases in which a non-target area sound segment is determined based on the amplitude spectrum ratio sum value and a target area sound segment is determined based on the coherence sum value, the area sound determination section 38 similarly uses the past determination result history to perform the determination. In the present exemplary embodiment, the area sound determination section 38 prioritizes determination with the amplitude spectrum ratio sum value if the same result is obtained less than a certain number of times; however, when such determination continues for the certain number of times or more, it is conceivable that the threshold value of the amplitude spectrum ratio sum value is highly likely to be too high, and the threshold value of the amplitude spectrum ratio sum value is therefore lowered, and after this, the area sound determination section 38 then re-performs the determination using the amplitude spectrum ratio sum value.

Moreover, the area sound determination section 38 may find the correlation coefficient between the amplitude spectrum ratio sum value and the coherence sum value, and update the threshold value of the amplitude spectrum ratio sum value. For example, in the present exemplary embodiment, the area sound determination section 38 may find the correlation coefficient for the two characteristic quantities after finding a moving average of the amplitude spectrum ratio sum value and the coherence sum value. The value is thereby made high in target area sound segments irrespective of the presence or absence of reverberation. Moreover, the correlation is high even in non-target area sound segments having no reverberation. However, the correlation is low in non-target area sound segments having reverberation since the amplitude spectrum ratio sum value is affected by the reverberation. It is therefore preferable for the area sound determination section 38 to raise the threshold value of the amplitude spectrum ratio sum value when the correlation coefficient drops below a certain value, and to set the threshold value so as to be suitable for the reverberation.

Next, explanation follows regarding detailed processing by the amplitude spectrum ratio computation section 37.

The amplitude spectrum ratio computation section 37 finds the amplitude spectrum ratio sum value by summing the amplitude spectrum ratio for all frequency components after computing the amplitude spectrum ratios based on the input signal supplied from the data input sections 1-1, 1-2, and the area sound outputs $Z_1$, $Z_2$ supplied from the target area sound extraction section 6.

More specifically, first, the amplitude spectrum ratio computation section 37 acquires the input signal supplied from the data input sections 1-1, 1-2, and the area sound outputs $Z_1$, $Z_2$ supplied from the target area sound extraction section 6, and computes the amplitude spectrum ratios.

Other respects thereof are similar to the specific processing of the amplitude spectrum ratio computation section 7 of the first exemplary embodiment, and explanation thereof is therefore omitted.

The detailed processing by the coherence computation section 30 is similar to that of the coherence computation section 20 of the second exemplary embodiment, and explanation thereof is therefore omitted.

Next, explanation follows regarding detailed processing by the area sound determination section 38.

Note that the format of the signal output by the area sound determination section 38 is not limited, and may, for example, be such that the target area sound pickup signals $Z_1$, $Z_2$ are output based on the output of all of the microphone arrays MA, or such that only some of the target area sound pickup signals (for example, one out of $Z_1$ and $Z_2$) are output.

FIG. 16 is an explanatory diagram illustrating an example of rules for updates to the threshold value performed by the area sound determination section 38.

First, the area sound determination section 38 determines both the amplitude spectrum ratio sum value and the coherence sum value using respective pre-set threshold values. Moreover, the area sound determination section 38 compares the two determination results and performs determination output processing in accordance with the results if the two determination results are the same. Moreover, when the two determinations are different, in cases in which a target area sound segment was determined by the amplitude spectrum ratio sum value and a non-target area sound segment was determined by the coherence sum value, the area sound determination section 38 follows the determination by the amplitude spectrum ratio sum value if the same result was obtained less than a certain number of times. However, when the same determination continues for the certain number of times or more, it is highly likely that the threshold value of the amplitude spectrum ratio sum value is exceeded in a non-target area sound segment due to the effect of reverberation, and the area sound determination section 38 therefore raises the threshold value of the amplitude spectrum ratio sum value and then re-performs the determination using the amplitude spectrum ratio sum value. On the other hand, in cases in which a non-target area sound segment was determined by the amplitude spectrum ratio sum value and a target area sound segment was determined by the coherence sum value, the determination follows the amplitude spectrum ratio sum value if the same result was obtained less than a certain number of times. However, when the same determination continues for the certain number of times or more, it is possible that the threshold value of the amplitude spectrum ratio sum value is too high, and the area sound determination section 38 therefore lowers the threshold value of the amplitude spectrum ratio sum value, and then re-performs the determination using the amplitude spectrum ratio sum value. Moreover, updates to the threshold value of the amplitude spectrum ratio sum value may be performed based on the correlation coefficient between the amplitude spectrum ratio sum value and the coherence sum value. In such cases, the area sound determination section 38 first finds a moving average of the amplitude spectrum ratio sum value and the coherence sum value. The area sound determination section 38 then finds the correlation coefficient from the two moving averages. The correction coefficient is a high value in target area sound segments irrespective of the presence or absence of reverberation. Moreover, correlation is also high in non-target area sound segments in the absence of reverberation. However, in non-target area sound segments having reverberation, the amplitude spectrum ratio sum value is influenced by reverberation and the correlation is low. This characteristic is utilized, and the area sound determination section 38 determines non-target area sound segments, and also lowers the threshold value of the amplitude spectrum ratio sum value, when the correlation coefficient has fallen below a certain value.

In the sound pickup device 300 of the third exemplary embodiment, segments in which target area sound is present and segments in which target area sound is not present are determined, and occurrence of abnormal sound is suppressed by not outputting sound that has been processed by area sound pickup processing in the segments in which target area sound is not present. Moreover, in the sound pickup device 300 of the third exemplary embodiment, both of the amplitude spectrum ratio sum value and the coherence sum is utilized at the determination. Thus, in the sound pickup device 300 of the third exemplary embodiment, abnormal sound can be suppressed from occurring when target area sound is not present in an environment where background noise is strong, by determining the presence or absence of target area sound, and not outputting the area sound output data when target area sound is absent.

Moreover, as described above, in the sound pickup device 300, the presence or absence of target area sound can be determined with high precision irrespective of the presence or absence of reverberation, since the presence or absence of target area sound is determined using both the amplitude spectrum ratio sum value and the coherence sum value.

(F) Modified Example of Third Exemplary Embodiment

Figure 17:
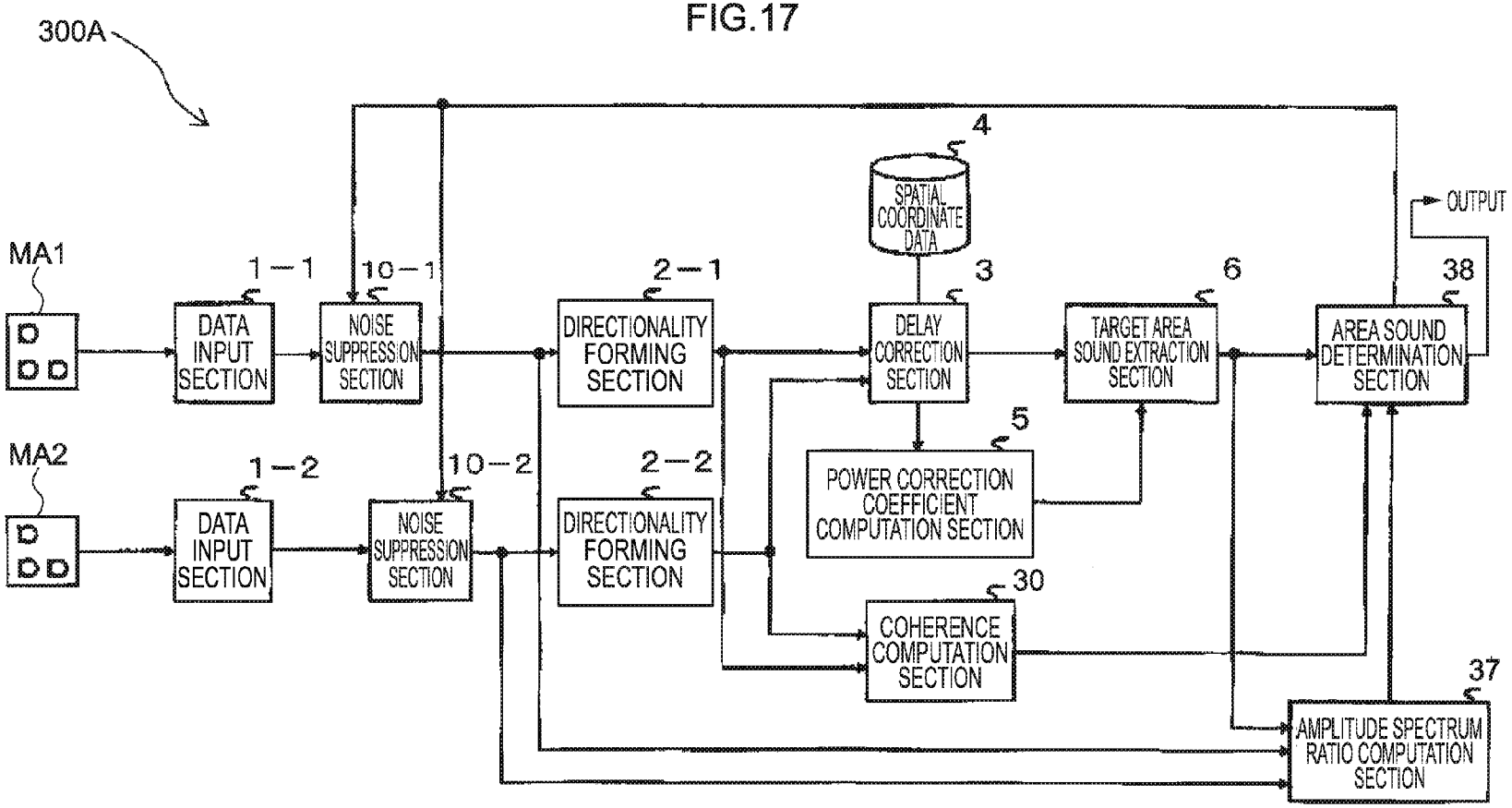
FIG. 17 is a block diagram illustrating a functional configuration of a pickup device according to a modified example of the third exemplary embodiment.
Figure 18:
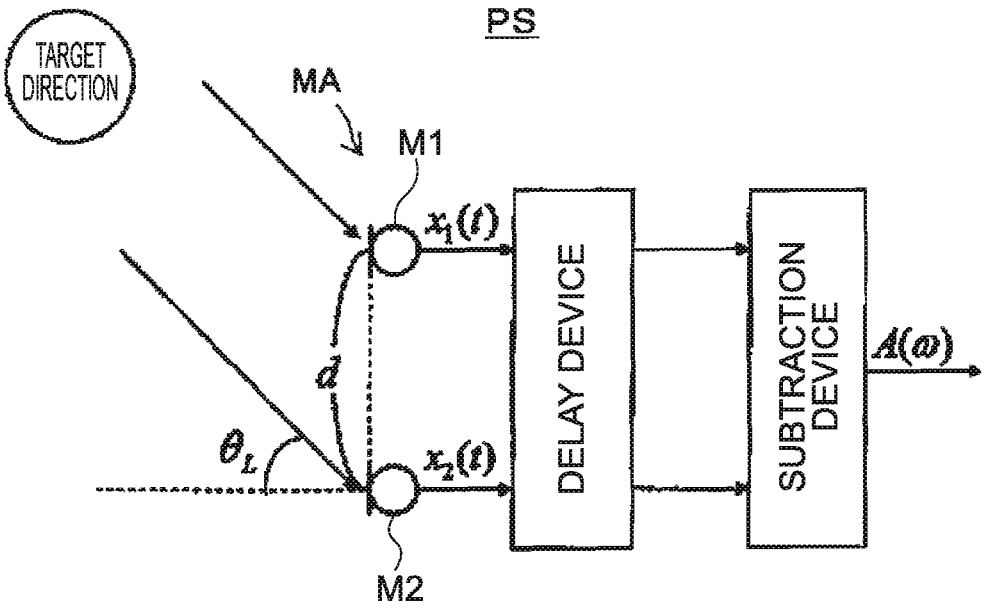
FIG. 18 is a diagram illustrating directionality formed by a subtraction-type beamformer using two microphones in a conventional sound pickup device.
Figure 19A:
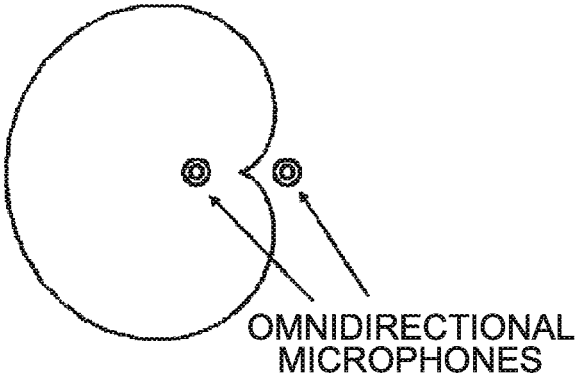
FIG. 19A is an explanatory diagram explaining an example of directionality formed by a conventional directional filter.
Figure 19B:
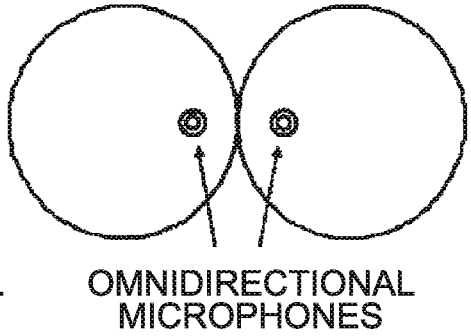
FIG. 19B is an explanatory diagram explaining an example of directionality formed by a conventional directional filter.

FIG. 17 is a block diagram illustrating a functional configuration of a sound pickup device 300A of a modified example of the third exemplary embodiment.

The sound pickup device 300A of the modified example of the third exemplary embodiment differs from the third exemplary embodiment in that two noise suppression sections 10 (10-1, 10-2) are added. The noise suppression sections 10-1 and 10-2 are inserted, respectively, between the data input sections 1-1, 1-2 and the directionality forming sections 2-1, 2-2. Moreover, the outputs of the noise suppression sections 10-1, 10-2 are also supplied to the amplitude spectrum ratio computation section 37.

The noise suppression sections 10-1, 10-2 use the determination results of the area sound determination section 38 (the detection results for the segments in which target area sound is present) to perform suppression processing for noise (sounds other than target area sound) on the signals (voice signals supplied from the respective microphones M of the respective microphones MA) supplied from the respective data input sections 1-1 and 1-2, and supply the processing results to the directionality forming sections 2-1 and 2-2, and to the amplitude spectrum ratio computation section 37.

Other respects are common to the sound pickup device 300 of the third exemplary embodiment and the sound pickup device 100A of the modified example of the first exemplary embodiment, similar reference numerals are allocated thereto, and explanation thereof is omitted.

In the modified example of the third exemplary embodiment, pickup of target area sound can be performed with higher precision than in the third exemplary embodiment due to the inclusion of the noise suppression sections 10.

Moreover, in the noise suppression sections 10, noise suppression can be performed to pickup of target area sound that is more suitable than in conventional noise suppression processing since the noise suppression processing can be performed using the determination results of the area sound determination section 38 (non-target area sound segments).

(G) Other Exemplary Embodiments

Technology disclosed herein is not limited to the exemplary embodiments described above, and examples of modified exemplary embodiments are given below.

(G-1) Although real-time processing of the audio signals captured by microphones is described in each of the exemplary embodiments above, audio signals captured by microphones may be stored on a recording medium, then read from the recording medium, and processed so as to obtain a signal that emphasizes target sounds or target area sounds. In cases in which a recording medium is used, the place where the microphones are placed and the place where the extraction processing for target sounds or target area sounds occurs may be separated from each other. Similarly, in the case of real-time processing also, the place where the microphones are placed and the place where the extraction processing for target sounds or target area sounds occurs may be separated, and a signal may be supplied to a remote location using communications.

(G-2) Although explanation has been given in which the microphone arrays MA employed by the sound pickup devices described above are three channel microphone arrays, two channel microphones may be employed (microphone arrays that include two microphones). In such cases, the directionality forming processing by the directionality forming sections may be substituted by various types of known filter processing.

(G-3) Although explanation has been given regarding configurations in which target area sound is picked up from the output of two microphone arrays in the sound pickup devices described above, configuration may be such that target area sound is picked up from the respective outputs of three or more microphone arrays. In such cases, configuration may be made such that the respective amplitude spectrum ratio sum values are computed in the amplitude spectrum ratio computation section 7 or 37 for all of the BF outputs of the microphone.

What is claimed is:

1. A sound pickup device comprising:

a directionality forming unit that forms directionality, in the direction of a target area, to output of a microphone array;

a target area sound extraction unit that extracts non-target area sound, present in the direction of the target area, from output of the directionality forming unit, and that suppresses non-target area sound components extracted from output of the directionality forming unit so as to extract target area sound;

a determination information computation unit that computes determination information from output of the directionality forming unit or output of the target area sound extraction unit;

an area sound determination unit that determines whether or not target area sound is present using the determination information computed by the determination information computation unit; and an output unit that outputs the target area sound extracted by the target area sound extraction unit in cases in which the target area sound is determined to be present by the area sound determination unit, and that does not output the target area sound extracted by the target area sound extraction unit in cases in which the target area sound is determined not to be present by the area sound determination unit.

2. The sound pickup device claim 1, wherein:

the determination information is an amplitude spectrum ratio sum value; and the determination information computation unit is an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency.

3. The sound pickup device of claim 1, wherein:

the determination information is a coherence sum value; and the determination information computation unit is a coherence computation unit that computes coherence for respective frequencies from output of the directionality forming unit, and that computes the coherence sum value by summing the coherences for each frequency.

4. The sound pickup device of claim 1, wherein:

the determination information is an amplitude spectrum ratio sum value and a coherence sum value; and the determination information computation unit is:

an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency; and a coherence computation unit that computes coherence for respective frequencies from output of the directionality forming unit, and that computes the coherence sum value by summing the coherences for each frequency.

5. The sound pickup device of claim 4, wherein the area sound determination unit:

performs first determination processing in which determination is made as to whether or not target area sound is present based on the coherence sum value, and second determination processing in which determination is made as to whether or not target area sound is present based on the amplitude spectrum ratio sum value; and outputs the determination processing result as a finalized determination processing result in cases in which the first determination processing result and the second determination result match, and decides a finalized determination processing result according to past determination processing result history in cases in which the first determination processing result and the second determination processing result are different from each other.

6. The sound pickup device of claim 1, wherein:

the target area sound extraction unit extracts, from output of the microphone array non-target area sound present in the direction of the target area, and performs spectral subtraction of the non-target area sound that has been extracted from output of the microphone array, from output of the directionality forming unit, so as to extract target area sound.

7. The sound pickup device of claim 1, wherein:

the directionality forming unit forms directionality in the direction of the target area to outputs from a plurality of respective microphone arrays; and the target area sound extraction unit includes:

a positional information storing unit that stores positional information related to the target area and the respective microphone arrays;

a delay correction unit that computes a delay arising in output of the directionality forming unit due to the distance between the target area and the respective microphone arrays, and corrects the output of the directionality forming unit such that target area sound arrives at all of the microphone arrays simultaneously;

a target area sound power correction coefficient computation unit that computes a ratio between outputs of the delay correction unit for each of the microphone arrays at respective frequencies in an amplitude spectrum, and that computes a most frequent value, or a central value, of the ratios as a correction coefficient; and a target area sound extraction unit that corrects the output of the delay correction unit for each of the microphone arrays using the correction coefficient computed by the target area sound power correction coefficient computation unit, that extracts non-target area sound present in the direction of the target area by performing spectral subtraction on the respective corrected outputs, and that then extracts target area sound by performing spectral subtraction of the extracted non-target area sound from output of the delay correction unit for the respective microphone arrays.

8. The sound pickup device of claim 1 further comprising:

a noise suppression unit that performs processing to suppress noise in the output of the directionality forming unit, using timings that depend on the determination result of the area sound determination unit, wherein the target area sound extraction unit extracts target area sound from output of the noise suppression unit.

9. A non-transitory computer readable medium storing a program causing a computer to execute sound pickup processing, the sound pickup processing comprising:

forming directionality in the direction of a target area to output of a microphone array so as to generate a first output;

extracting non-target area sound present in the direction of the target area from the first output, and suppressing non-target area sound components extracted from the first output so as to extract target area sound as a second output;

computing determination information from the first output or the second output;

determining whether or not target area sound is present using the determination information; and outputting the target area sound extracted in cases in which the target area sound is determined to be present, and not outputting the target area sound extracted in cases in which the target area sound is determined not to be present.

10. The non-transitory computer readable medium storing a program of claim 9, wherein:

the determination information is an amplitude spectrum ratio sum value, and the amplitude spectrum ratio sum value is computed by computing an amplitude spectrum from the second output, computing amplitude spectrum ratios for respective frequencies using the amplitude spectrum of the second output and an amplitude spectrum of an input signal of the microphone array, and summing the amplitude spectrum ratios for each frequency.

11. The non-transitory computer readable medium storing a program of claim 9, wherein:

the determination information is a coherence sum value, and the coherence sum value is computed by computing coherence for respective frequencies from the first output, and summing the coherences for each frequency.

12. The non-transitory computer readable medium storing a program of claim 9, wherein:

the determination information is an amplitude spectrum ratio sum value and a coherence sum value, the amplitude spectrum ratio sum value is computed by computing an amplitude spectrum from the second output, computing amplitude spectrum ratios for respective frequencies using the amplitude spectrum of the second output and an amplitude spectrum of an input signal of the microphone array, and summing the amplitude spectrum ratios for each frequency, and the coherence sum value is computed by computing coherence for respective frequencies from the first output, and summing the coherences for each frequency.

13. A sound pickup method comprising:

forming directionality in the direction of a target area to output of a microphone array so as to generate a first output;

extracting non-target area sound present in the direction of the target area from the first output, and suppressing non-target area sound components extracted from the first output so as to extract target area sound as a second output;

computing determination information from the first output or the second output;

determining whether or not target area sound is present using the determination information; and outputting the target area sound extracted in cases in which the target area sound is determined to be present, and not outputting the target area sound extracted in cases in which the target area sound is determined not to be present.

14. The sound pickup method of claim 13, wherein:

the determination information is an amplitude spectrum ratio sum value, and the determination information computation unit is an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency.

15. The sound pickup method of claim 13, wherein:

the determination information is a coherence sum value, and the determination information computation unit is a coherence computation unit that computes coherence for respective frequencies from output of the directionality forming unit, and that computes the coherence sum value by summing the coherences for each frequency.

16. The sound pickup method of claim 13, wherein:

the determination information is an amplitude spectrum ratio sum value and a coherence sum value, and the determination information computation unit is:

an amplitude spectrum ratio computation unit that computes an amplitude spectrum from output of the target area sound extraction unit, that computes amplitude spectrum ratios for respective frequencies using the amplitude spectrum and an amplitude spectrum of an input signal of the microphone array, and that computes the amplitude spectrum ratio sum value by summing the amplitude spectrum ratios for each frequency; and a coherence computation unit that computes coherence for respective frequencies from output of the directionality forming unit, and that computes the coherence sum value by summing the coherences for each frequency.

* * * * *